US011944166B2

(12) United States Patent
Lee

(10) Patent No.: US 11,944,166 B2
(45) Date of Patent: Apr. 2, 2024

(54) MODULAR INTERCHANGEABLE JEWELRY

(71) Applicant: Alison Lee, Norwalk, CT (US)

(72) Inventor: Alison Lee, Norwalk, CT (US)

( * ) Notice: Subject to any disclaimer, the term of this patent is extended or adjusted under 35 U.S.C. 154(b) by 337 days.

(21) Appl. No.: 17/188,117

(22) Filed: Mar. 1, 2021

(65) Prior Publication Data

US 2021/0177110 A1 Jun. 17, 2021

Related U.S. Application Data

(63) Continuation-in-part of application No. 15/343,396, filed on Nov. 4, 2016, now abandoned.

(51) Int. Cl.
*A44C 15/00* (2006.01)
*A44C 5/02* (2006.01)
*A44C 25/00* (2006.01)

(52) U.S. Cl.
CPC ..... *A44C 25/002* (2013.01)

(58) Field of Classification Search
CPC ..... A44C 25/002; A44C 25/00; A44C 13/00
See application file for complete search history.

(56) References Cited

U.S. PATENT DOCUMENTS 1,386,591 A * 8/1921 Anderson ..... A44C 5/02 59/80
4,238,905 A * 12/1980 MacGraw, II ..... A63H 33/046 446/92
4,882,915 A * 11/1989 Porcaro ..... A44C 25/004 63/18
4,982,581 A * 1/1991 Furuyama ..... A44C 17/0216 63/29.1
7,654,110 B2 * 2/2010 Azar ..... A44C 5/2071 63/3
8,376,807 B2 * 2/2013 Fogarty ..... A63H 33/26 446/485
8,596,090 B1 * 12/2013 Smith ..... A44C 17/0216 63/900
8,763,357 B1 * 7/2014 Arnone ..... A44C 25/007 59/83
9,364,056 B1 * 6/2016 Azar ..... A44C 25/001
2003/0046797 A1 * 3/2003 Buettell ..... A45F 5/02 24/316
2004/0126621 A1 * 7/2004 Fukuda ..... A61N 2/06 600/15
2005/0148809 A1 * 7/2005 Delaney ..... A61N 2/06 63/3

(Continued)

*Primary Examiner* — Emily M Morgan
(74) *Attorney, Agent, or Firm* — Gearhart Law, LLC; David Postolski

(57) ABSTRACT

A jewelry kit is described that includes at least a first and a second polygonal shape. Each shape includes a planar portion having a first side disposed opposite a second side and one or more walls located on a periphery of the first side of the planar portion and extending away from the first side of the planar portion to form an interior portion. A new polygonal shape is formed from affixing, via an adhesive or a magnetic connection, the second shape inside of the first shape or the second shape to the first shape in some fashion. Objects may be received within an interior portion of the new shape. At least one adjustable bale is affixed to an exterior wall of the new shape. At least one adjustable and spring-loaded jump ring is affixed to the exterior wall or another exterior wall of the new shape.

14 Claims, 35 Drawing Sheets

(56) References Cited

U.S. PATENT DOCUMENTS

| | | | | |
|---|---|---|---|---|
| 2005/0210917 | A1* | 9/2005 | Wiseman | A44C 27/006 63/4 |
| 2006/0137396 | A1* | 6/2006 | Ma | A44C 5/0023 63/15 |
| 2009/0031757 | A1* | 2/2009 | Harding | A44C 5/003 63/3 |
| 2010/0083698 | A1* | 4/2010 | Secord | A63B 71/0672 63/1.13 |
| 2012/0060861 | A1* | 3/2012 | Van Cleef | A45D 33/30 132/316 |
| 2012/0180522 | A1* | 7/2012 | Severs | A44C 17/0208 63/12 |
| 2013/0160489 | A1* | 6/2013 | Arjang | A44C 17/0208 63/29.2 |
| 2013/0263625 | A1* | 10/2013 | Taylor-Cattapan | A44C 17/0258 63/26 |
| 2014/0072942 | A1* | 3/2014 | Haramein | G09B 23/181 434/281 |
| 2015/0173471 | A1* | 6/2015 | Weems | A44C 25/004 63/19 |
| 2015/0216285 | A1* | 8/2015 | Grainger | A44C 9/0069 206/581 |
| 2015/0223580 | A1* | 8/2015 | Kinney | B65B 55/20 53/445 |
| 2015/0352892 | A1* | 12/2015 | Nemzer | B44C 3/00 428/28 |
| 2017/0099916 | A1* | 4/2017 | Burr | A44C 1/00 |
| 2019/0037978 | A1* | 2/2019 | Haramein | A44C 13/00 |

* cited by examiner

MODULAR INTERCHANGEABLE JEWELRY

CLAIM OF PRIORITY

This application is a U.S. Non-Provisional Patent Application and Continuation-in-Part (CIP) that claims priority to U.S. Non-Provisional patent application Ser. No. 15/343,396 filed on Nov. 4, 2016, the entire contents of which are hereby incorporated by reference in their entirety.

FIELD OF THE EMBODIMENTS

The field of the embodiment of the present invention relates to kits for making jewelry.

BACKGROUND OF THE EMBODIMENTS

There is an unmet need for creating original jewelry without having to use or learn to use a torch or solder. There is an unmet need for creating original jewelry without having to use or learn to use a torch for soldering or metalsmithing skills for original fabrication. Also, consumers have to spend a lot of money to buy alternative designs of jewelry especially if they want to change their jewelry often. With the present invention, these unmet needs are met and these problems solved.

A review of the related art and technologies reveals the following:

U.S. Pat. No. 6,581,413 teaches a system of interconnected ornamental rings which convey a definite and clear message regarding the existence of an interpersonal relationship which, when worn by an individual, cannot be mistaken in the culture. In a preferred embodiment, the inventive system of interconnected ornamental rings comprises a pair of separate finger rings, each having a connection point at which there is attached a decorative chain interconnecting the separate rings. The system of interconnected rings can be worn on two fingers of the hand, with a finger in-between them, so that the decorative chain is prominently displayed. The message conveyed by such a pair of interconnected ornamental rings is very clear, indicating an interpersonal relationship with another, with the decorative chain which enhances the message with its particular type of decorative style. The system of interconnected ornamental rings provides several functions, including an indication function acceptable in the culture, by indicating an existing interpersonal relationship. It will be clear to all who notice the inventive jewelry ornament that the wearer has an existing interpersonal relationship. The system of ornamental rings provides a way of representing the object of the wearer's affections, and these may even be toward a favorite pet.

U.S. Pat. No. 2,840,983 discloses a plurality of links interconnected to form a resilient self-coiling chain construction, each link including an under-looped portion and an upper-looped portion extending to overlie said under-looped portion, the latter extending beyond said upper-looped portion, a bight means interconnecting said under-looped and upper looped portions and having folded leaf spring properties, said upper-looped and under-looped portions each having end sections extending through the bight means of an adjoining link forming a double eye-coupling, said loop sections being in a predetermined spaced relation to each other, said bight means serving to resist pressure forces applied to bring said end sections closer together, said bight means of one link and end sections of an adjoining link being so constructed and arranged to permit maximum spacing of said loop sections of said first link when the links are disposed at less than degrees providing the self-coiling action of the chain construction and movement of the links toward a 180 degree uncoiling relation causing compression of said sections within said bight means applying a resilient force for returning the chain construction to said self-coiling condition.

U.S. Pat. No. 5,647,103 discloses a clasp formed of beveled members, one a male member and the other a female member, which inter-engage together and are retained in their connection through capillary and frictional forces. The female member may contain a slot, to facilitate its resilient widening, to receive the male member, once inserted. The male member may include, at its frontal portion, a slot, to provide for its compression, and formation of a bevel proximate its front end to facilitate its interconnection with the female member into the beveled clasp. A modification includes a beaded type connector that interconnects together through the formation of a bead, interiorly of the female member, and a complementary groove, formed proximate the beveled front end of the male member, to facilitate the interconnection of the clasp together, and to sustain its hold during coupling.

U.S. Pat. No. 5,632,164 teaches a jewelry pendant assembly is provided. The assembly comprises a frame member having an outside edge and an inside edge, the latter defining a window there through. Also provided is a series of interrelated and interconnected jewelry stones mounted together in a substantially planar array and which are mounted behind said frame member.

U.S. Pat. No. 6,164,815 discloses a modular jewelry item, particularly a ring, an earring, a pendant, or a timepiece such as a watch, consisting of at least one hollow portion and one central portion complementary in shape to the hollow portion, said central portion being detachable from the hollow portion.

EP1767113A teaches an ornament consisting of a number of interchangeable decorative modules that can be worn or used on their own or grouped together. Each module has two contact surfaces, one of which is studded with equally-spaced permanent magnets, while the other is of a ferromagnetic material for the magnets to adhere to. The modules can be decorated, for example with gems, precious metals or enamel.

Various systems and methodologies are known in the art. However, their structure and means of operation are substantially different from the present disclosure. The other inventions fail to solve all the problems taught by the present disclosure. At least one embodiment of this invention is presented in the drawings below and will be described in more detail herein.

SUMMARY OF THE EMBODIMENTS

The present invention relates to kits for making jewelry. A first embodiment of the present invention describes a jewelry kit. The jewelry kit comprises a first polygonal shape (e.g., a bezel) and a second polygonal shape. It should be appreciated that the quantity of the polygonal shapes is not limited to two. Each of the first polygonal shape and the second polygonal shape comprise: a planar portion having a first side disposed opposite a second side and one or more walls located on a periphery of the first side of the planar portion and extending away from the first side of the planar portion to form an interior portion. The planar portion and each of the one or more walls comprise a magnetic portion.

In examples, each of the first polygonal shape and the second polygonal shape comprise: a circular shape, an oval shape, a rectangular shape, a diamond shape, a moon shape, a star shape, a heart shape, a half-moon shape, a half circle shape, a pie slice shape, a square shape, a triangular shape, a quadrilateral shape, a pentagonal shape, a hexagonal shape, a heptagonal shape, an octagonal shape, a nonagonal shape, or a decagonal shape, among other shapes not explicitly listed herein. In some examples, the magnetic portion is located within the planar portion and each of the one or more walls of the first polygonal shape and the second polygonal shape. In other examples, the magnetic portion is located within the planar portion of the first polygonal shape and the second polygonal shape and the magnetic portion is affixed to an exterior of each of the one or more walls of the first polygonal shape and the second polygonal shape.

The jewelry kit also comprises a new polygonal shape formed from affixing the magnetic portion of the planar portion of the second polygonal shape to the magnetic portion of the planar portion of the first polygonal shape such that the second polygonal shape is received in the first polygonal shape. The new polygonal shape comprises a planar portion having a first side disposed opposite a second side, one or more exterior walls located on a periphery of the first side of the planar portion and extending away from the first side of the planar portion to form a first interior portion, and one or more interior walls located on and extending away from the first side of the planar portion to form a second interior portion. Each of the planar portion, the one or more exterior walls, and the one or more interior walls comprise another magnetic portion.

In a first example, the other magnetic portion of the new polygonal shape is located within each of the planar portion, the one or more exterior walls, and the one or more interior walls. In a second example, the other magnetic portion of the new polygonal shape is located within the planar portion and within each of the one or more interior walls and the other magnetic portion of the new polygonal shape is affixed to each of one or more exterior walls.

Each of the magnetic portion and the other magnetic portion are selected from the group consisting of: a cobalt magnet, a neodymium magnet, a samariun cobalt magnet, and another rare earth magnet.

The jewelry kit also includes a first set of objects receivable in the first interior portion of the new polygonal shape and a second set of objects receivable in the second interior portion of the new polygonal shape. In some examples, the first set of the objects is identical to the second set of the objects. In another example, the first set of the objects differs from the second set of the objects. Each object of the first set of the objects and the second set of the objects are selected from the group consisting of: a pearl, a gem, a precious stone, a bead, a crystal, a charm, a shell, a shrink plastic creation, and a craft item.

The jewelry kit also includes at least one adjustable bale affixed to a wall of the one or more exterior walls of the new polygonal shape. The at least one adjustable bale includes a planar portion affixed to a semi-circular portion at a first location and at a second location, forming an opening therein. The semi-circular portion comprises a spring-loaded material. Further, the at least one adjustable bale includes a jagged section affixed to the second location and extending away from the semi-circular portion, wherein an action on the jagged section increases or decreases a size of the opening. The jagged section extends on the first side of the planar portion of the new polygonal shape. A component is received via the opening to affix the new polygonal shape to a necklace, a bracelet, a bangle, a cuff link, an earring, a belt, a broach, a pin, a keychain, a headband, an ornament, a ring, a crown, a tiara, a hairpin, a pet collar, a picture frame, an anklet, or an art piece.

The jewelry kit also includes at least one adjustable and spring-loaded jump ring affixed to the wall or another wall of the one or more exterior walls of the new polygonal shape. The at least one adjustable and spring-loaded jump ring is configured to receive a third set of objects thereon, where each object of the third set of objects includes: a pearl, a gem, a precious stone, a bead, a crystal, a charm, a shell, a shrink plastic creation, or a craft item.

A second embodiment of the present invention describes a jewelry kit. The jewelry kit includes a first polygonal shape and a second polygonal shape. Each of the first polygonal shape and the second polygonal shape comprises: a planar portion having a first side disposed opposite a second side and one or more walls located on a periphery of the first side of the planar portion and extending away from the first side of the planar portion to form an interior portion.

A new polygonal shape is formed from affixing, via an adhesive, the planar portion of the second polygonal shape to the planar portion of the first polygonal shape such that the second polygonal shape is received in the first polygonal shape. The new polygonal shape comprises: a planar portion having a first side disposed opposite a second side, one or more exterior walls located on a periphery of the first side of the planar portion and extending away from the first side of the planar portion to form a first interior portion, and one or more interior walls located on and extending away from the first side of the planar portion to form a second interior portion. A paint, an enamel, an ink, and/or a gloss are received in the first interior portion and/or the second interior portion.

The jewelry kit also includes a first set of objects receivable in the first interior portion of the new polygonal shape and a second set of objects receivable in the second interior portion of the new polygonal shape. In a first example, the first set of the objects is identical to the second set of the objects. In a second example, the first set of the objects differ from the second set of the objects.

In some examples, the first set of the objects are affixed in the first interior portion and the second set of the objects are affixed in the second interior portion via an adhesive. The adhesive may be: a glue, a tape, a spray, a mod podge, a clay, a concentrate, a resin, an embossing powder, an apoxie sculpt, and/or an enamel. The clay may be: a polymer clay, a paper clay, a metal clay, and/or a crystal clay.

The jewelry kit also includes at least one adjustable bale affixed to a wall of the one or more exterior walls of the new polygonal shape and at least one adjustable and spring-loaded jump ring affixed to the wall or another wall of the one or more exterior walls of the new polygonal shape.

The jewelry kit may also include a spring-loaded frame affixed to a periphery of the one or more exterior walls of the new polygonal shape.

A third embodiment of the present invention describes a jewelry kit. The jewelry kit includes a first polygonal shape and a second polygonal shape. Each of the first polygonal shape and the second polygonal shape comprise: a planar portion having a first side disposed opposite a second side and one or more walls located on a periphery of the first side of the planar portion and extending away from the first side of the planar portion to form an interior portion. Each of the one or more walls comprise a magnetic portion.

A new polygonal shape is formed from affixing the magnetic portion of at least one wall of the one or more walls of the first polygonal shape to the magnetic portion of at least one wall of the one or more walls of the second polygonal shape. The new polygonal shape includes: a planar portion having a first side disposed opposite a second side and one or more walls located on a periphery of the first side of the planar portion and extending away from the first side of the planar portion to form an interior portion. Each of the one or more walls comprise another magnetic portion.

Each of the magnetic portion and the other magnetic portion are selected from the group consisting of: a cobalt magnet, a neodymium magnet, a samariun cobalt magnet, and another rare earth magnet.

A set of objects is receivable in the interior portion of the new polygonal shape. Moreover, at least one adjustable bale is affixed to a wall of the one or more walls of the new polygonal shape and at least one adjustable and spring-loaded jump ring affixed to the wall or another wall of the one or more walls of the new polygonal shape. The at least one adjustable and spring-loaded jump ring is deformable. Moreover, a component is received by the at least one adjustable bale to affix the new polygonal shape to a necklace, a bracelet, a bangle, a cuff link, an earring, a belt, a broach, a pin, a keychain, a headband, an ornament, a ring, a crown, a tiara, a hairpin, a pet collar, a picture frame, an anklet, or an art piece.

DESCRIPTION OF THE PREFERRED EMBODIMENTS

Figure 1:
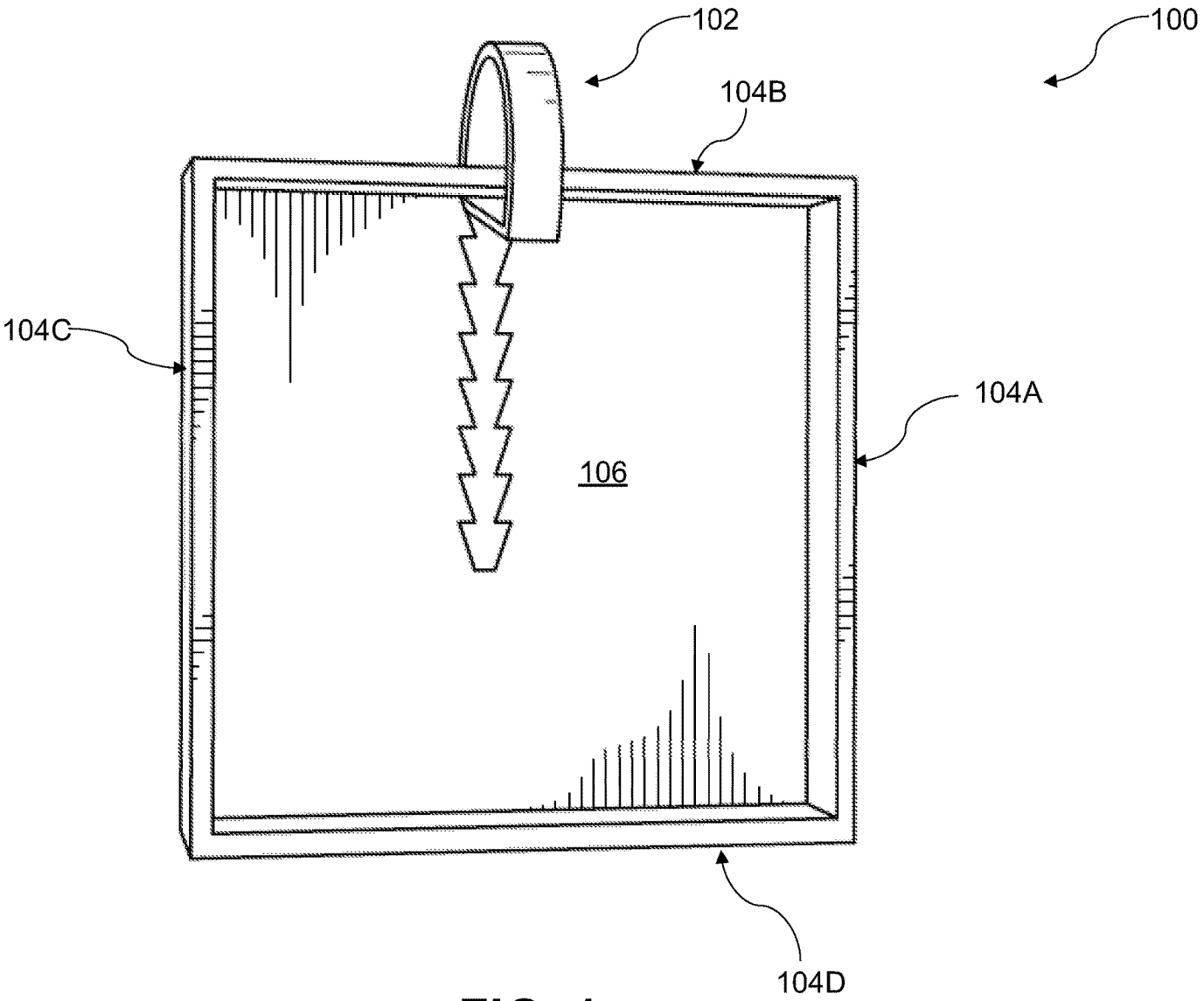
FIG. 1 depicts a perspective view of a polygonal piece of a jewelry kit and a bale, according to at least some embodiments disclosed herein.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

The present invention relates to kits for making jewelry. A jewelry kit is described and depicted. The jewelry kit comprises a first polygonal shape 100 (e.g., a bezel) and a second polygonal shape 200. As described herein, a "bezel" is a type of jewelry setting that may receive objects therein, such as shapes, stones, beads, etc. It should be appreciated that the jewelry kit may include additional polygonal shapes and the quantity of the polygonal shape is not limited to two. Each of the first polygonal shape 100 and the second polygonal shape 200 comprise: a planar portion having a first side disposed opposite a second side 110 and one or more walls 104A, 104B, 104C, and/or 104D located on a periphery of the first side of the planar portion and extending away from the first side of the planar portion to form an interior portion 106, as shown in at least FIG. 1 and FIG. 2.

In examples, each of the first polygonal shape 100 and the second polygonal shape 200 comprise: a circular shape, an oval shape, a rectangular shape, a diamond shape, a moon shape, a star shape, a heart shape, a half-moon shape, a half circle shape, a pie slice shape, a square shape, a triangular shape, a quadrilateral shape, a pentagonal shape, a hexagonal shape, a heptagonal shape, an octagonal shape, a nonagonal shape, or a decagonal shape, among other shapes not explicitly listed herein. In some examples, the first polygonal shape 100 and the second polygonal shape 200 are identical in a size and/or a shape. In other examples, the first polygonal shape 100 and the second polygonal shape 200 differ in the size and/or the shape.

In some examples, a magnetic portion 116 (e.g., a magnet or a magnetic piece) is located within the planar portion and each of the one or more walls 104A, 104B, 104C, and/or 104D of the first polygonal shape 100 and the second polygonal shape 200, as shown in FIG. 7D, FIG. 7E, FIG. 7F, FIG. 7G, FIG. 7S, FIG. 7U, FIG. 7V, FIG. 7W, and FIG. 7Z. In other examples, the magnetic portion 116 is located within the planar portion of the first polygonal shape 100 and the second polygonal shape 200 and the magnetic portion 116 is affixed to an exterior of each of the one or more walls 104A, 104B, 104C, and/or 104D of the first polygonal shape 100 and the second polygonal shape 200, such as shown in FIG. 7A, FIG. 7B, FIG. 7C, FIG. 7H, FIG. 7I, FIG. 7J, FIG. 7K, FIG. 7L, FIG. 7M, FIG. 7N, FIG. 7O, FIG. 7Q, FIG. 7R, FIG. 7T, FIG. 7X, and FIG. 7Y.

Figure 7A:
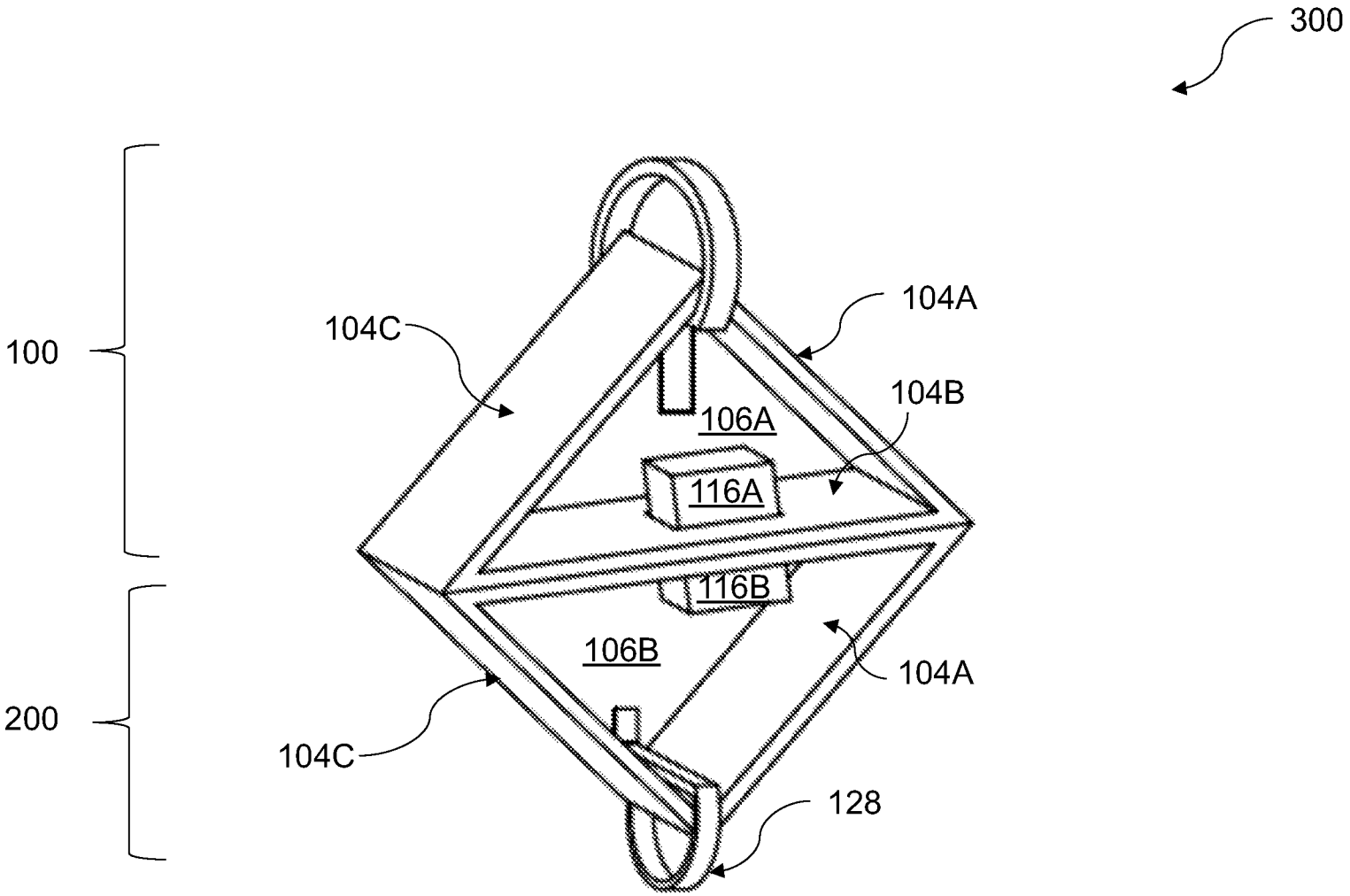
FIG. 7A-FIG. 7Z depict perspective views of polygonal pieces of a jewelry kit affixed together to form new polygonal pieces, according to at least some embodiments disclosed herein.
Figure 7B:
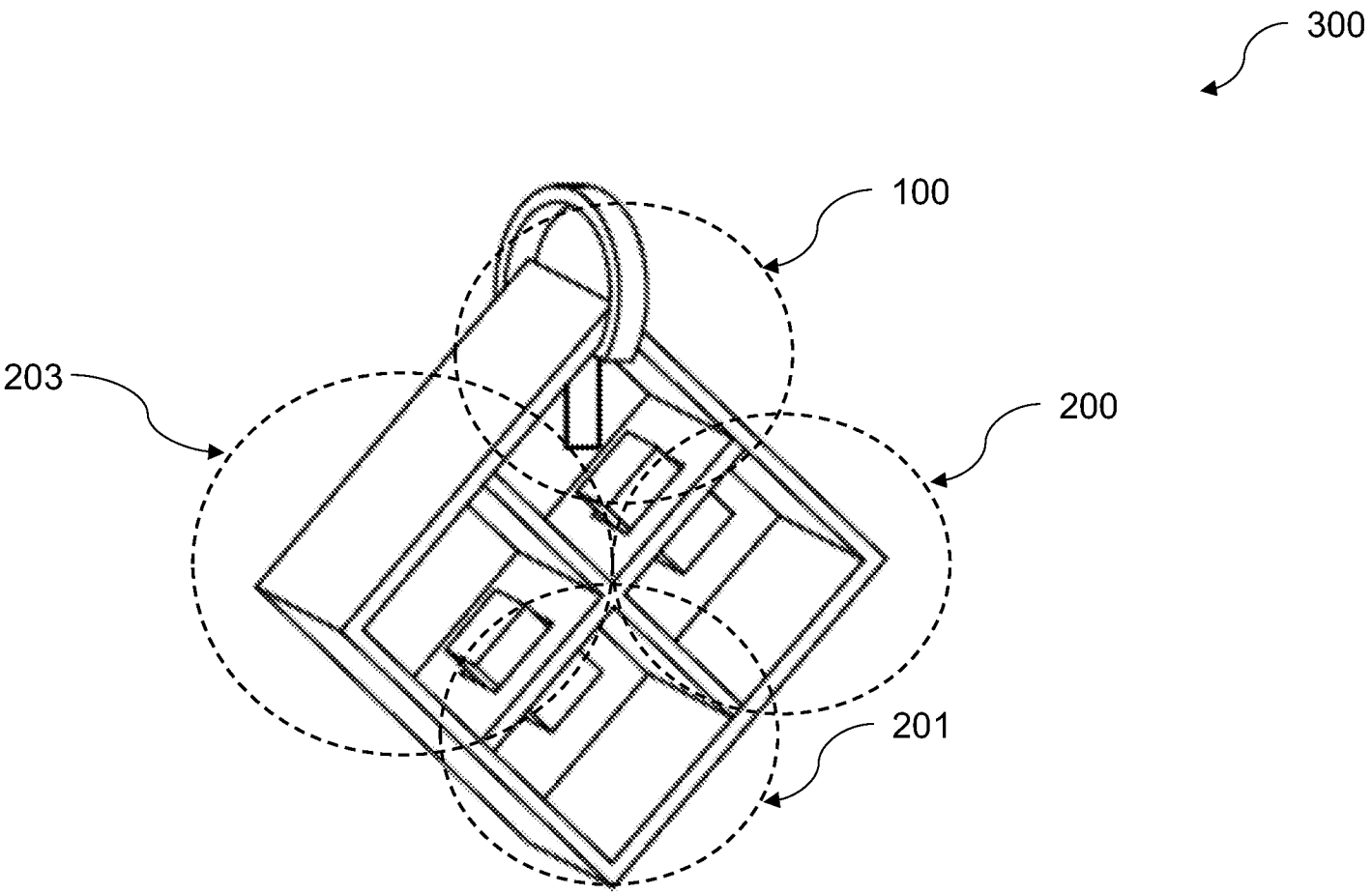
Figure 7C:
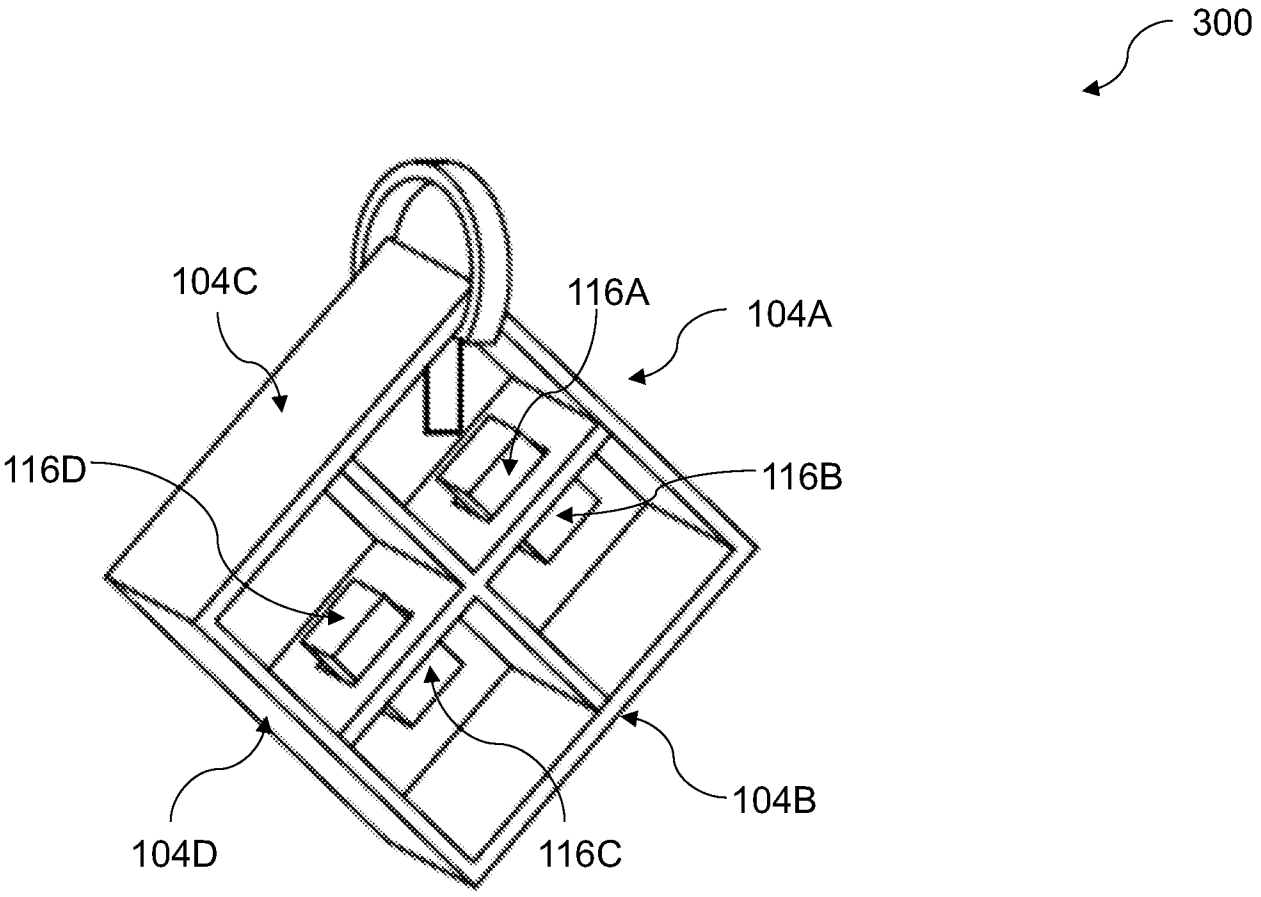
Figure 7D:
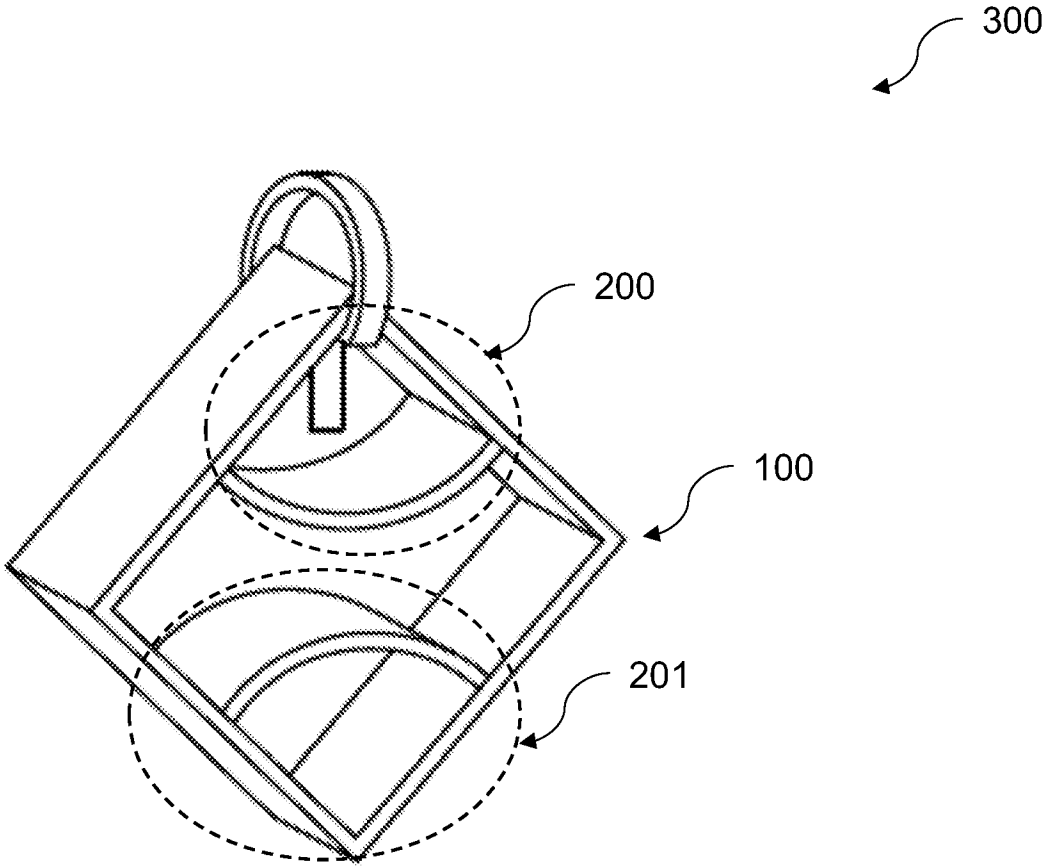
Figure 7E:
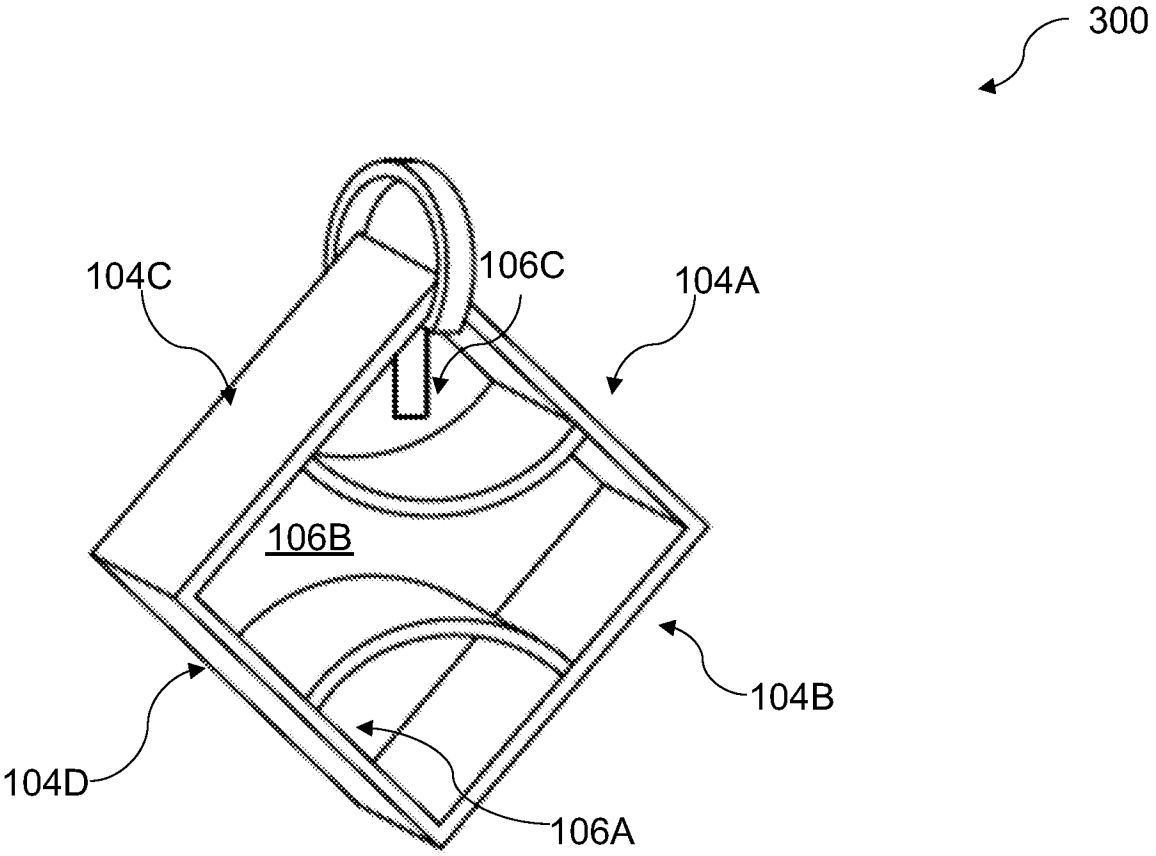

A new polygonal shape 300 may be formed from affixing the second polygonal shape 200 inside of the first polygonal shape 100. For example, as shown in FIG. 7D and FIG. 7E, the new polygonal shape 300 is formed from affixing the second polygonal shape 200 and a third polygonal shape 201 inside of the first polygonal shape 100. As shown in FIG. 7F, FIG. 7G, FIG. 7S, FIG. 7U, and FIG. 7V, the new polygonal shape 300 is formed from affixing the second polygonal shape 200 inside of the first polygonal shape 100.

In other examples, such as in FIG. 7A, FIG. 7J, FIG. 7Q, and FIG. 7R, the new polygonal shape 300 may be formed by affixing the second polygonal shape 200 to a portion of the first polygonal shape 100. In further examples, such as in FIG. 7B, FIG. 7C, FIG. 7X, and FIG. 7Y, the new polygonal shape 300 may be formed by affixing more than two polygonal shapes together. For example, as shown in FIG. 7B, the first polygonal shape 100, the second polygonal shape 200, the third polygonal shape 201, and a fourth polygonal shape 203 may be affixed together to form the new polygonal shape 300.

Figure 7F:
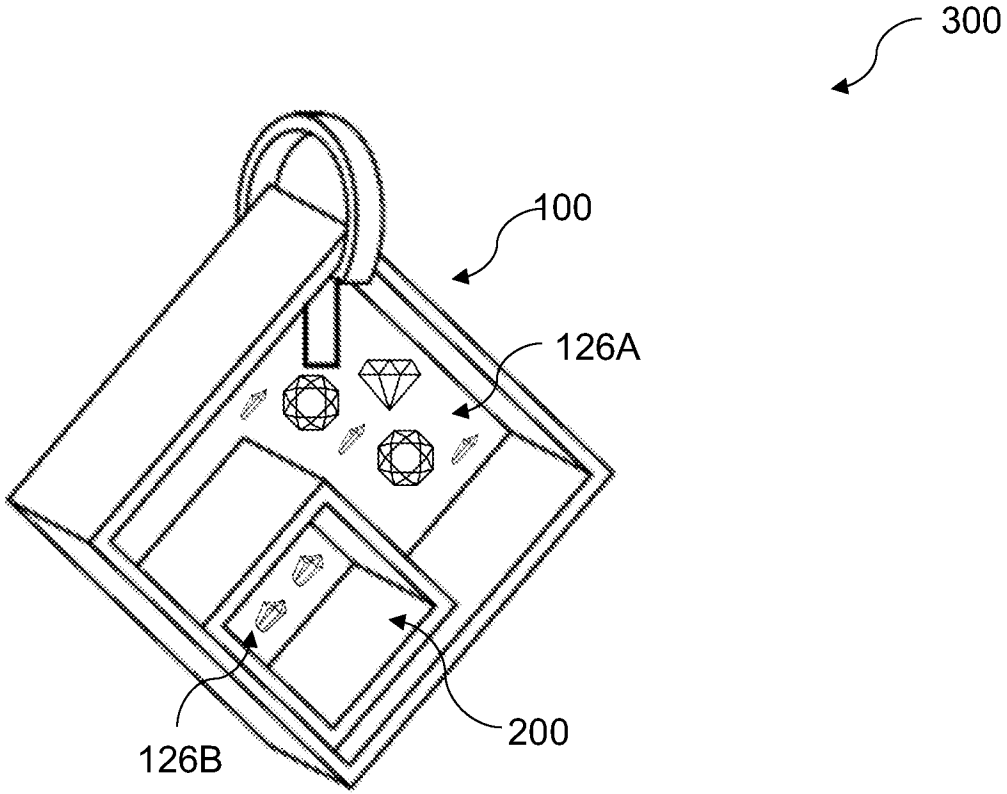
Figure 7G:
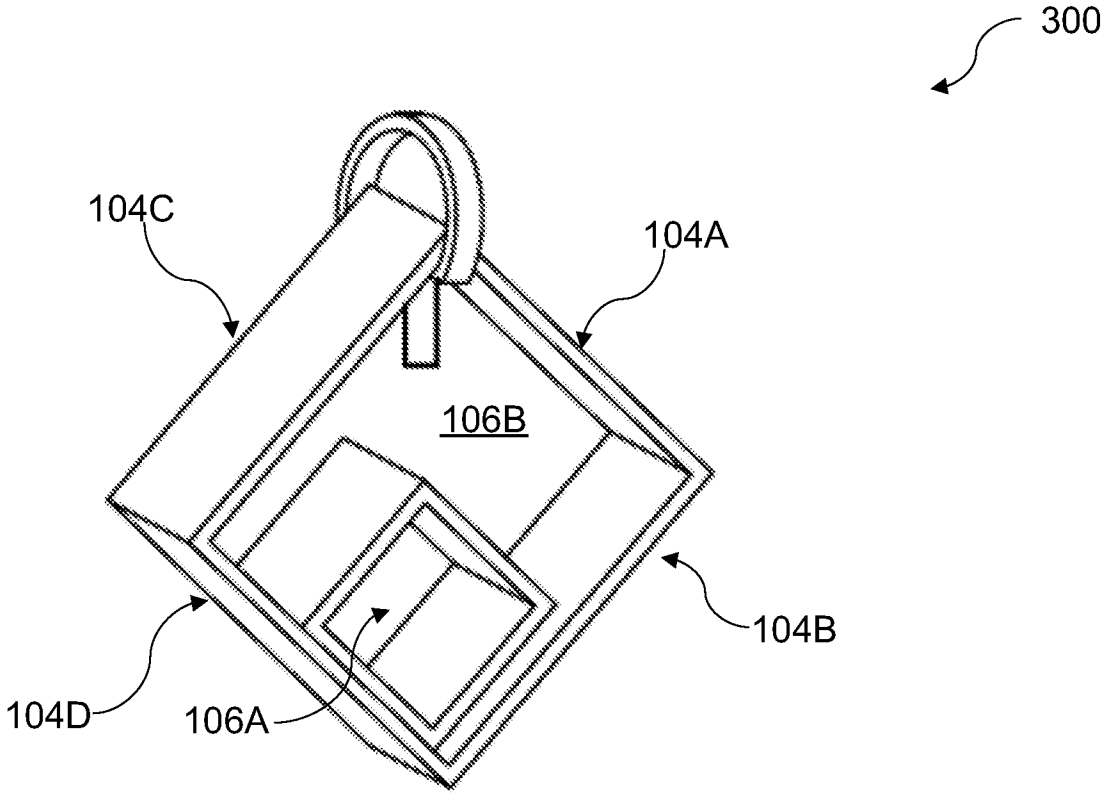
Figure 7H:
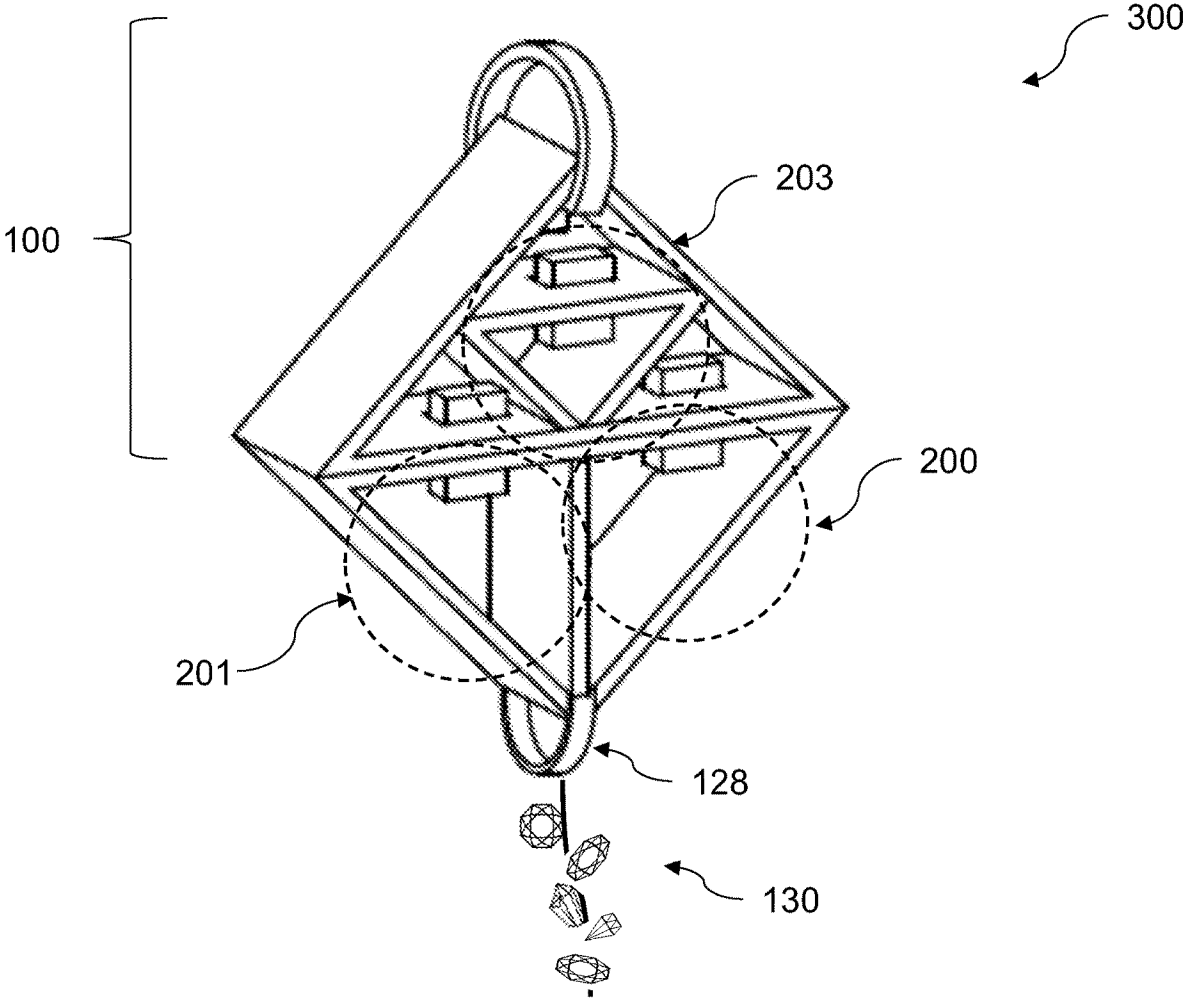
Figure 7I:
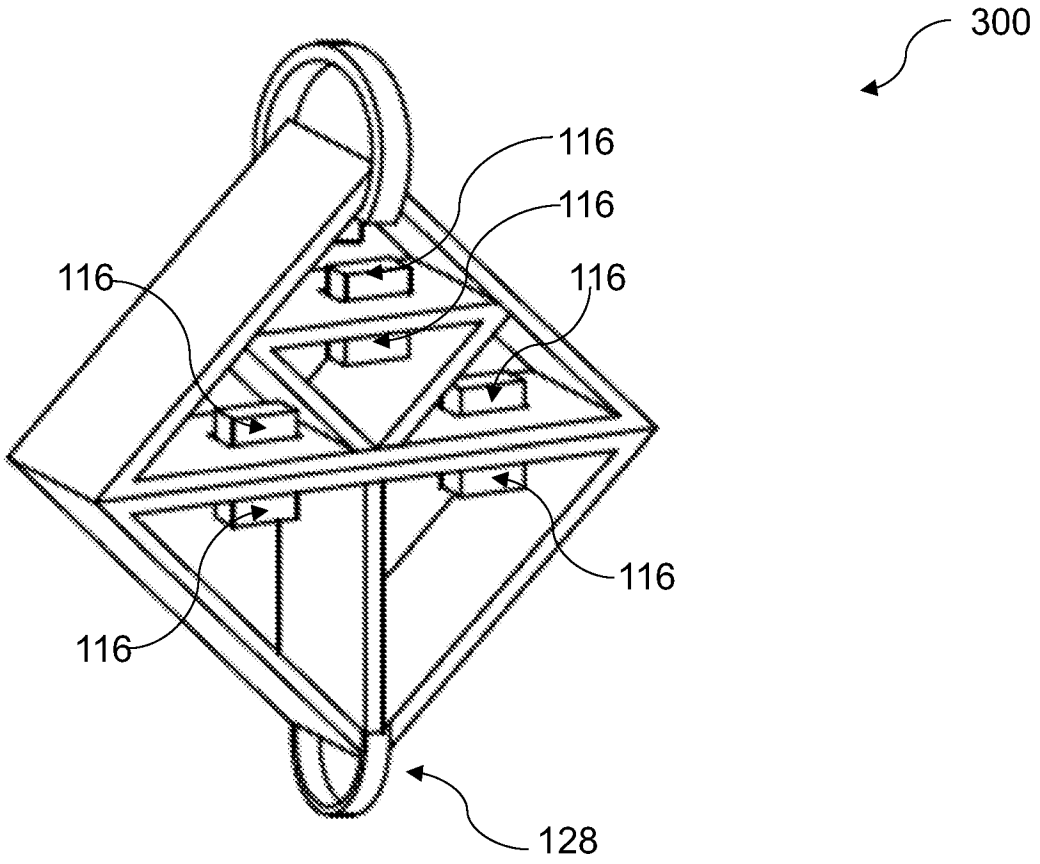
Figure 7J:
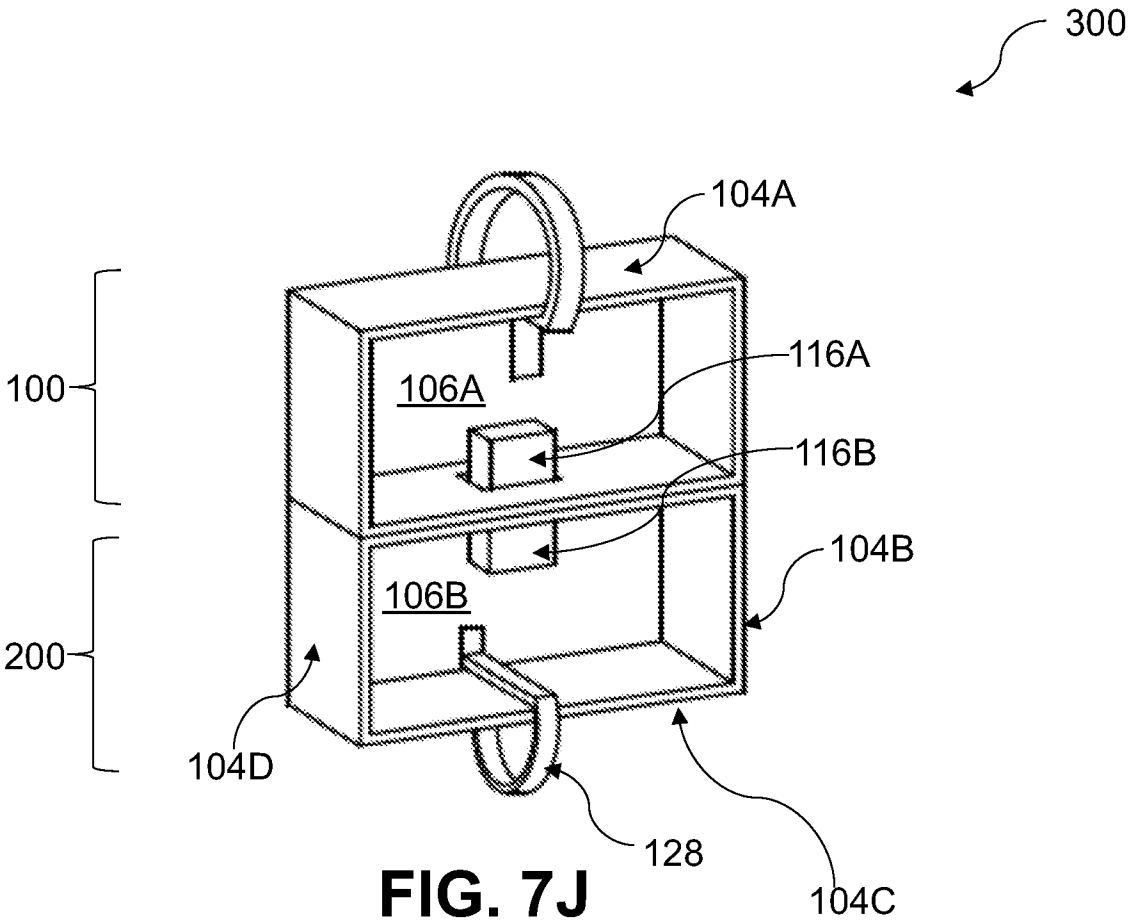
Figure 7K:
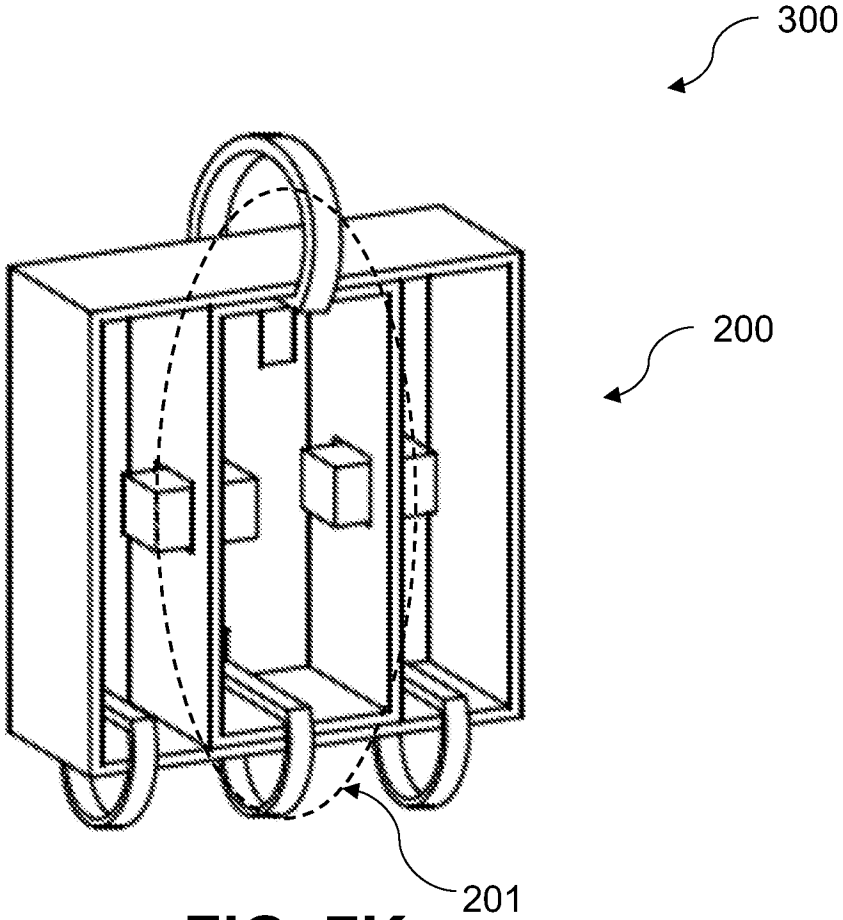
Figure 7L:
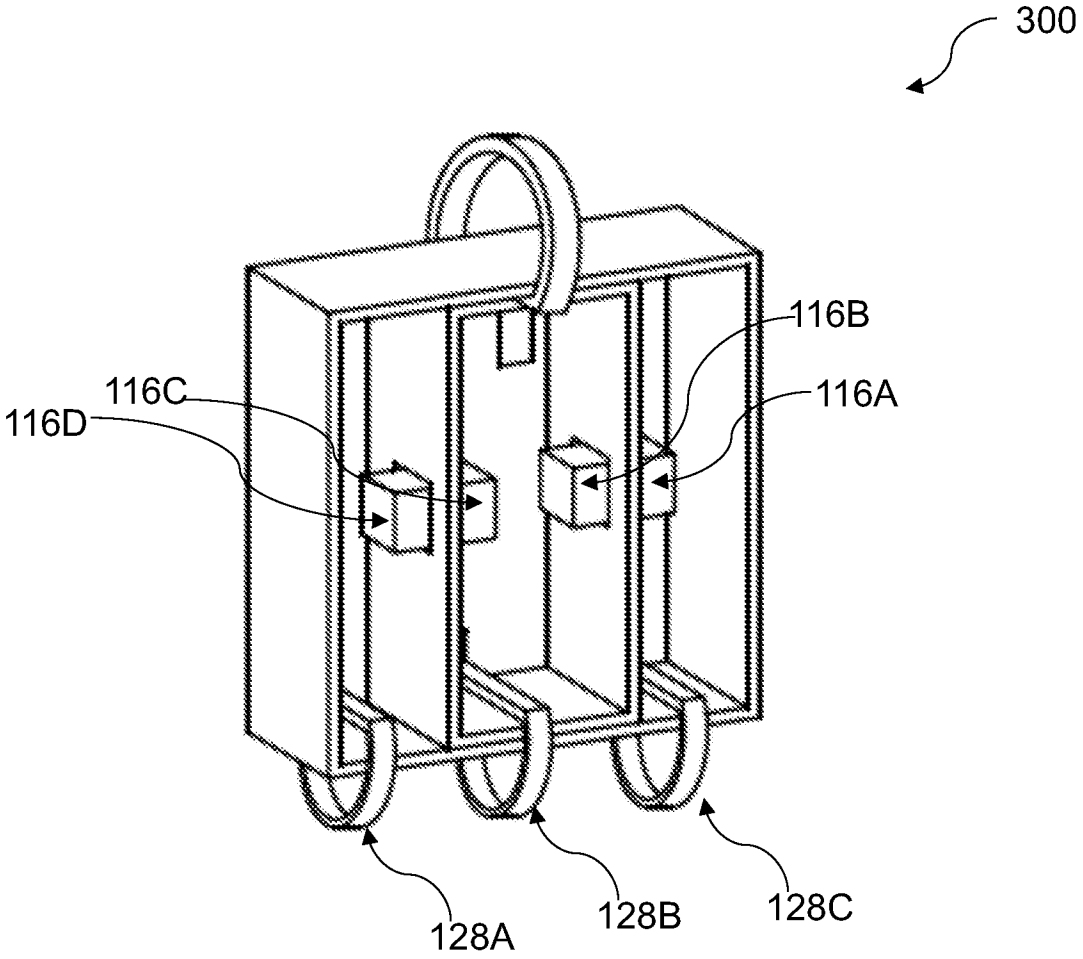
Figure 7M:
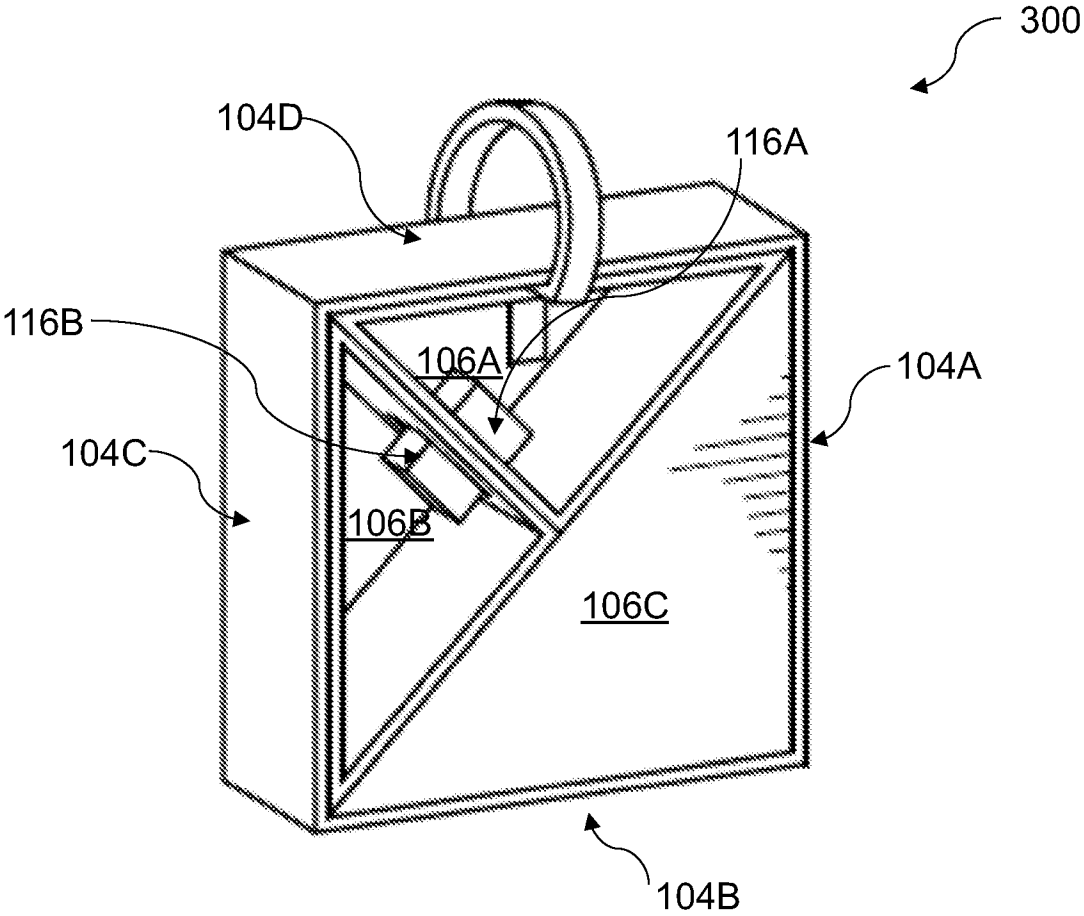
Figure 7N:
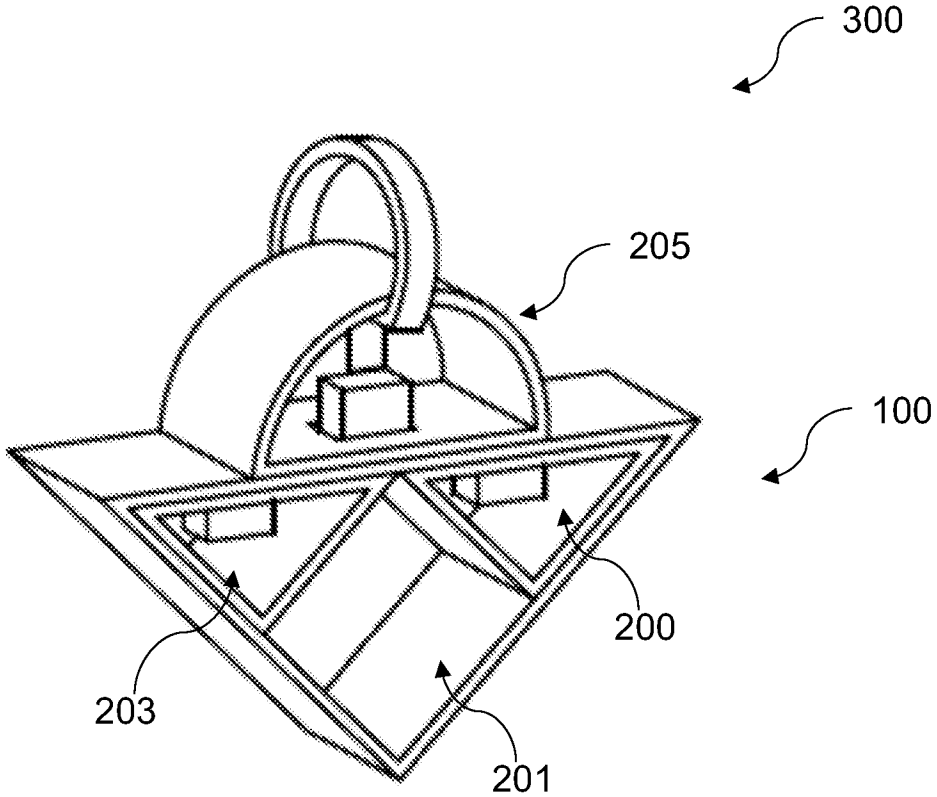
Figure 7O:
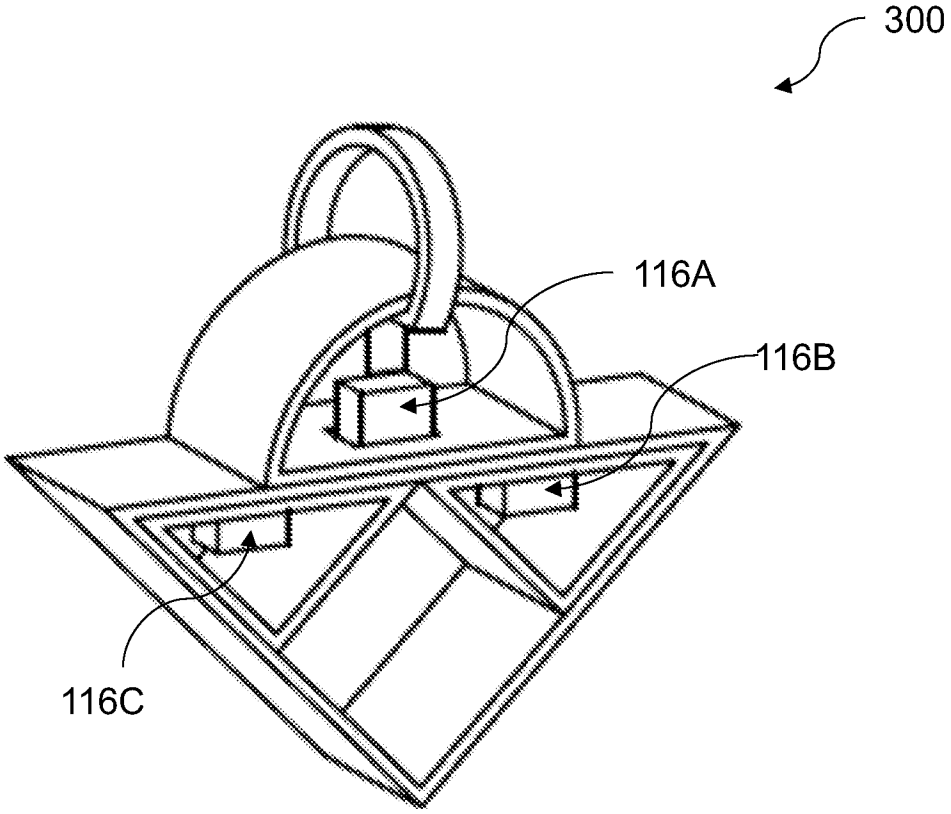
Figure 7P:
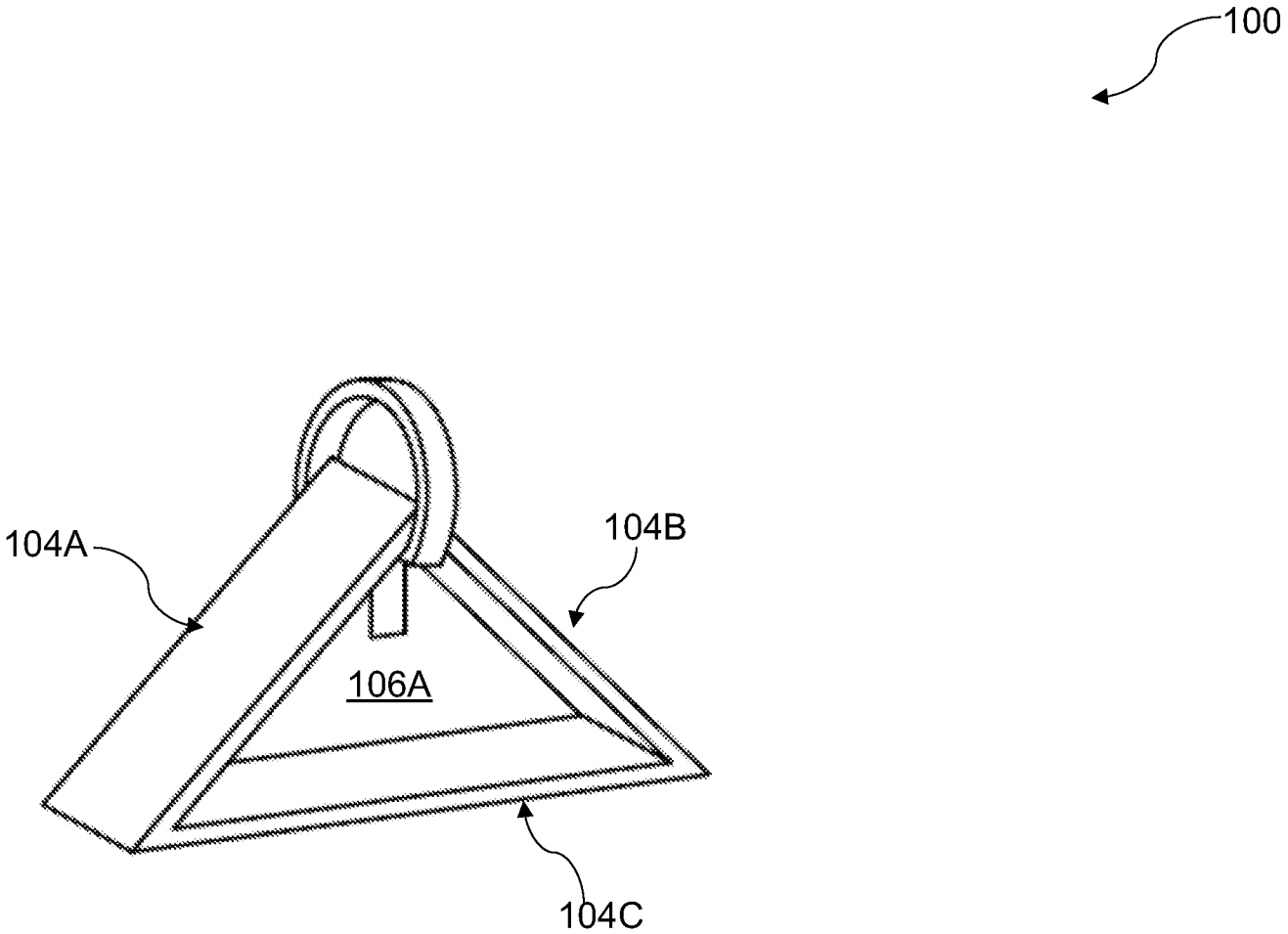
Figure 7Q:
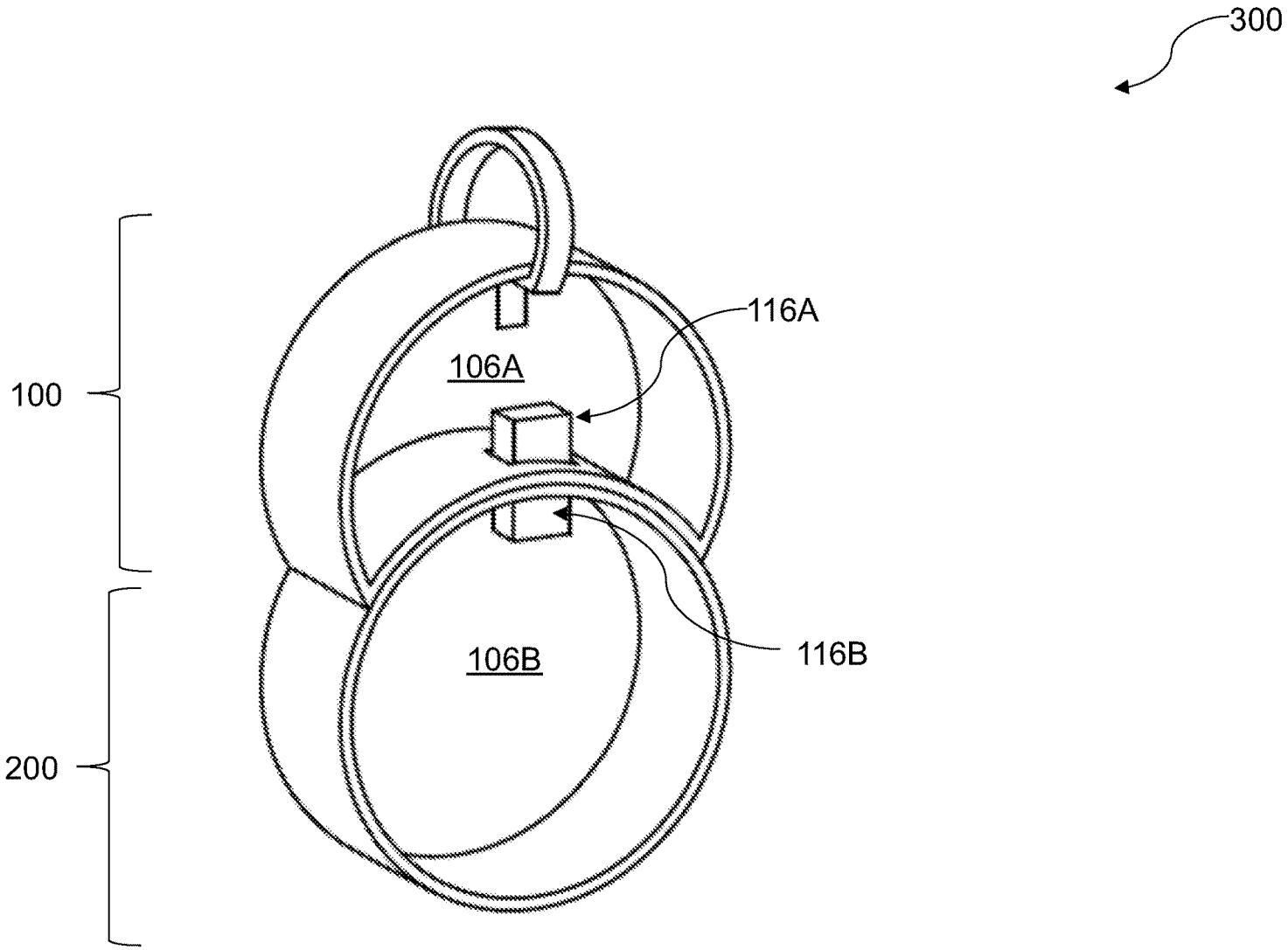
Figure 7R:
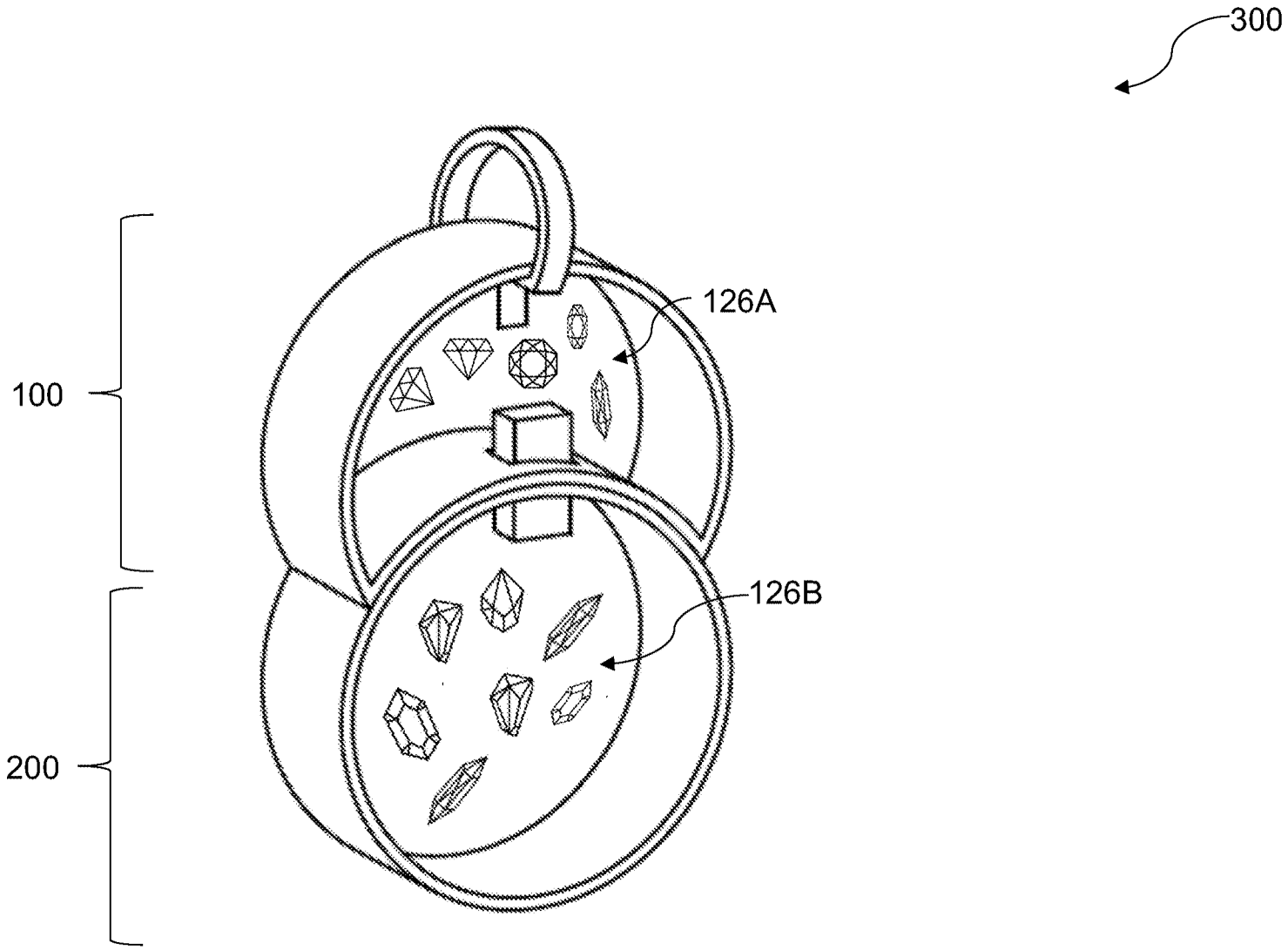
Figure 7S:
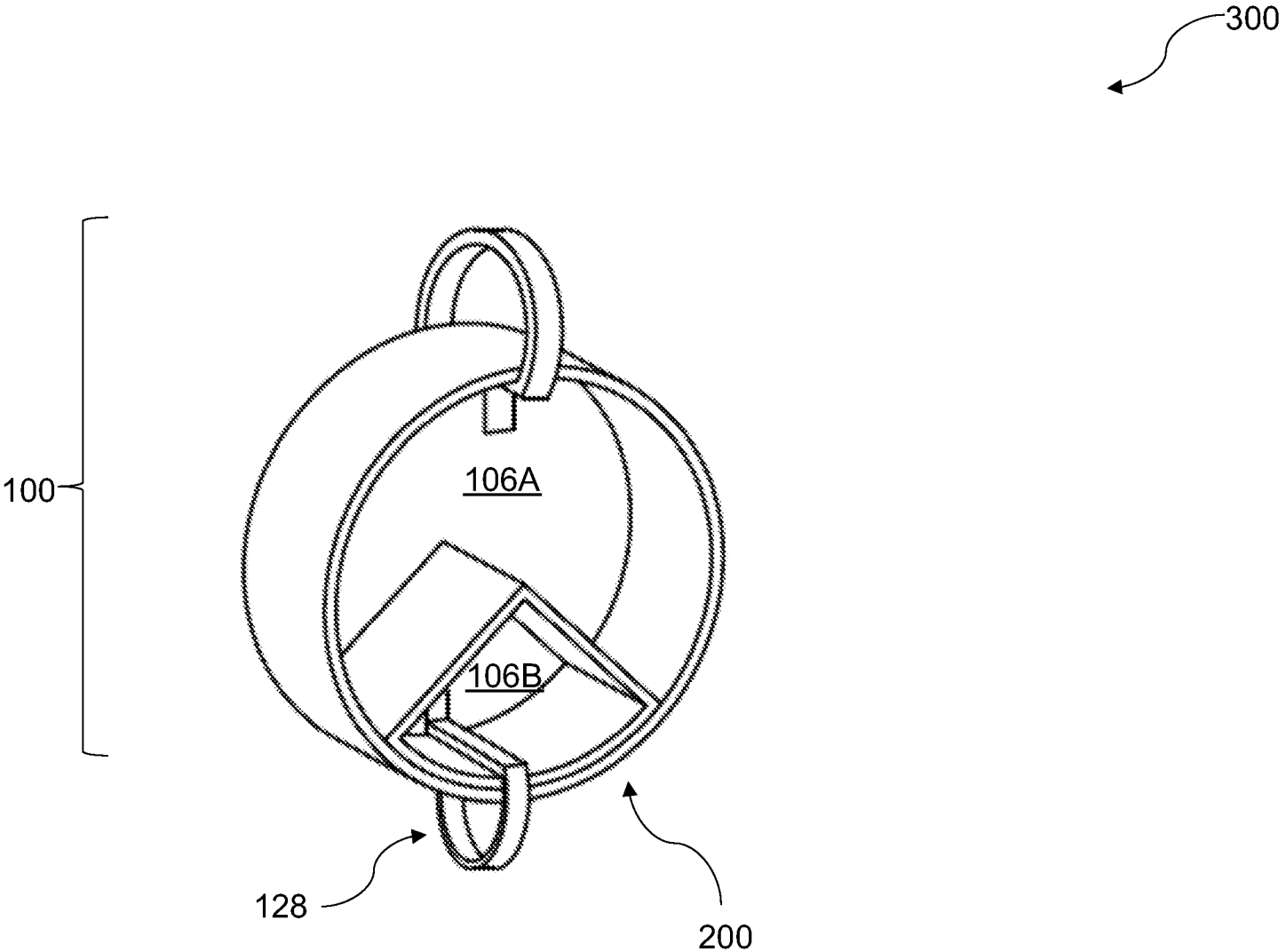
Figure 7T:
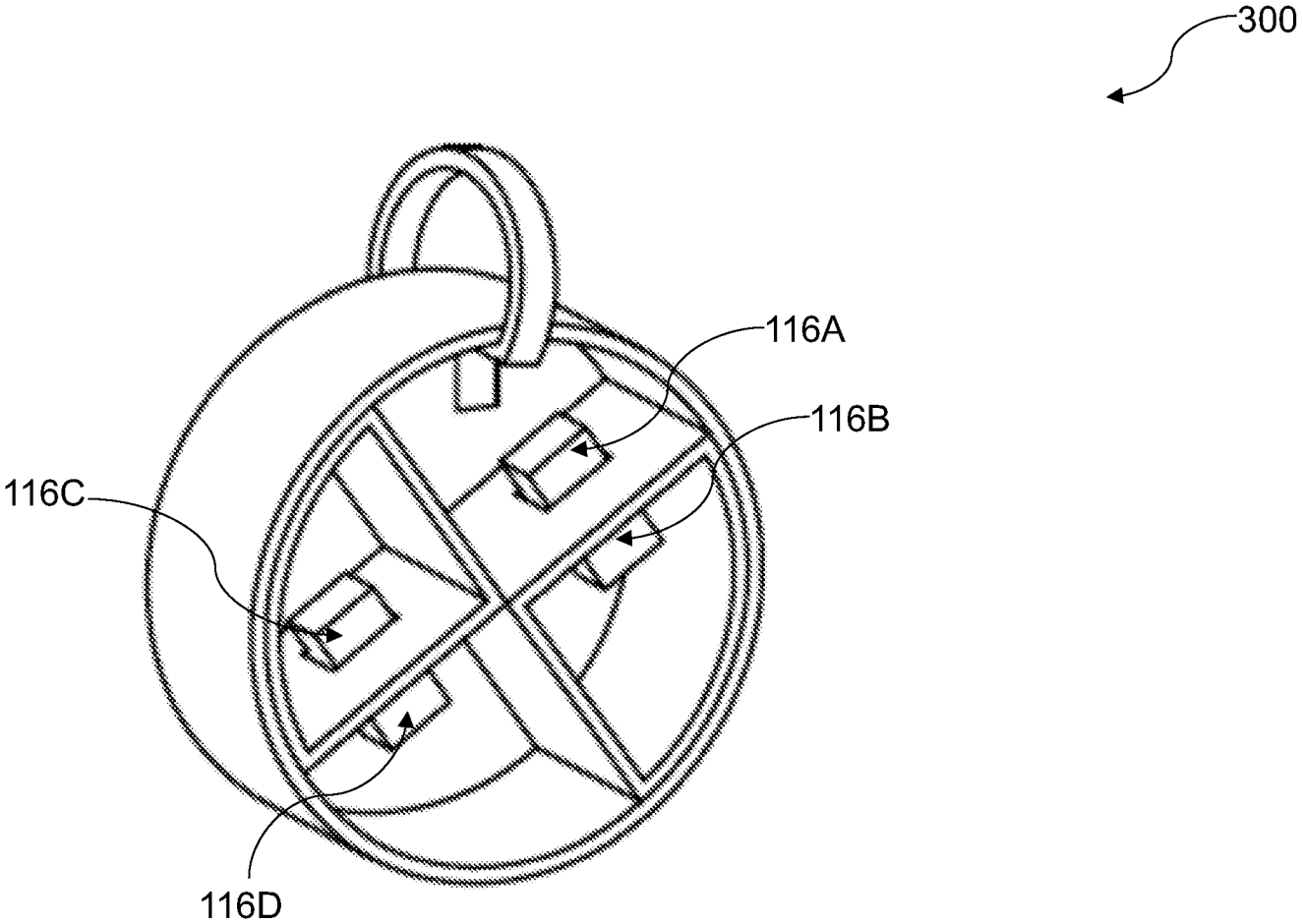
Figure 7U:
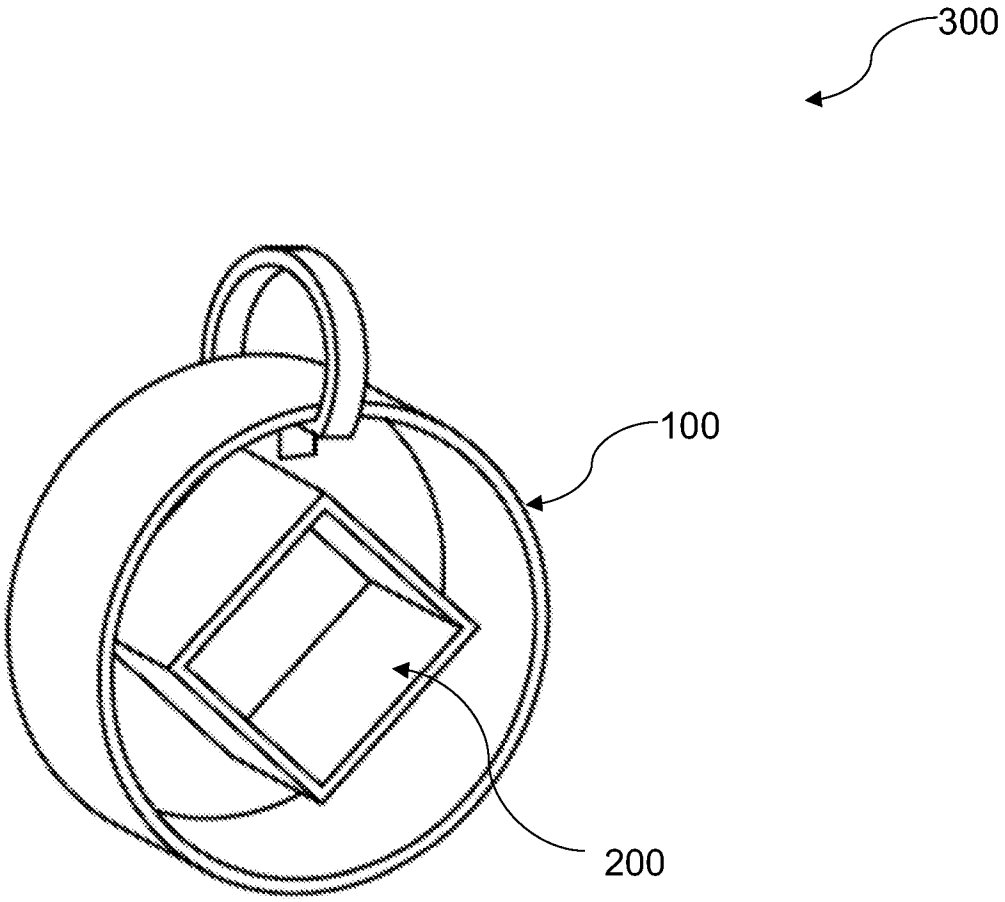
Figure 7V:
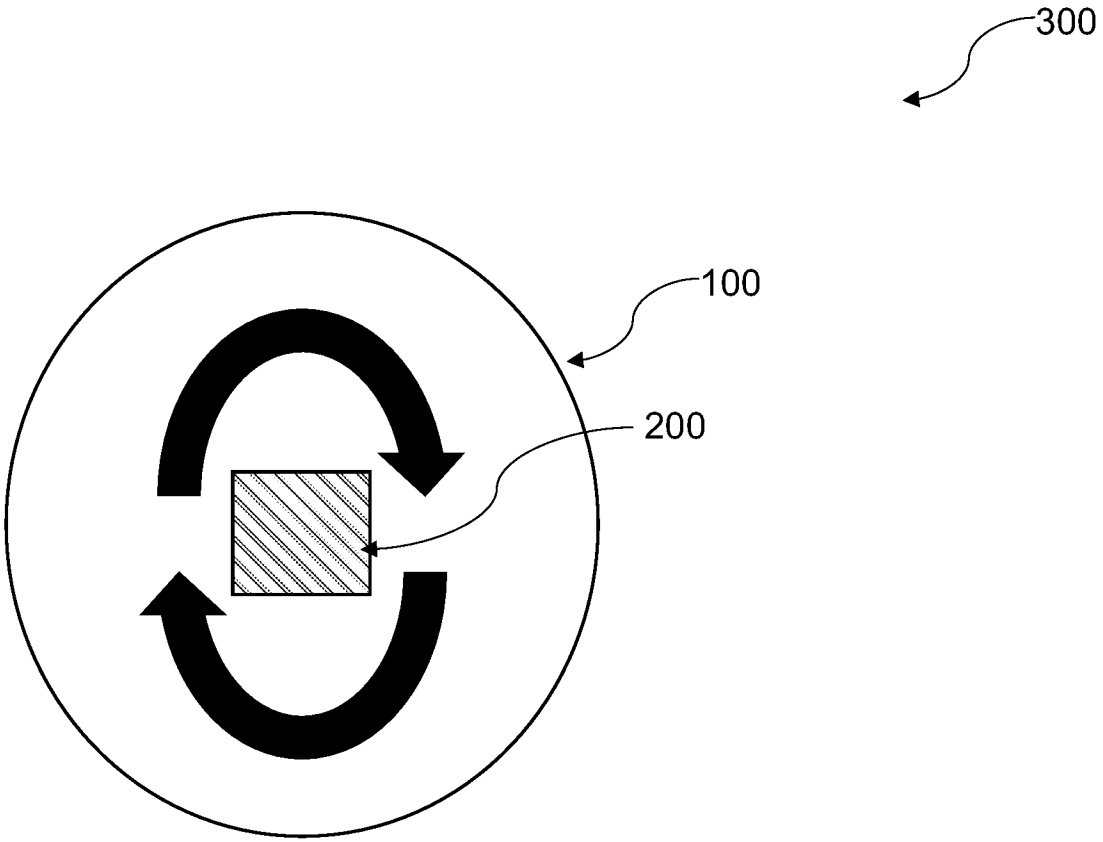
Figure 7W:
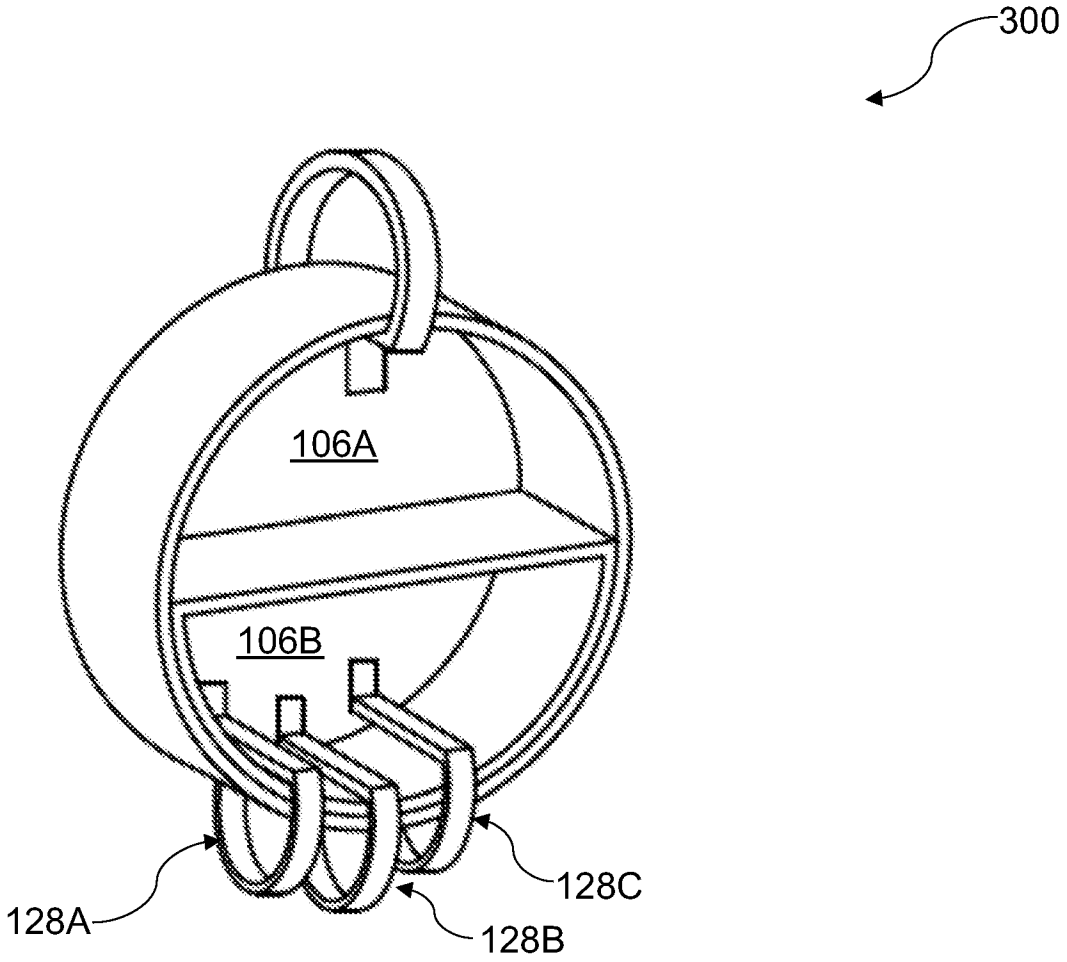
Figure 7X:
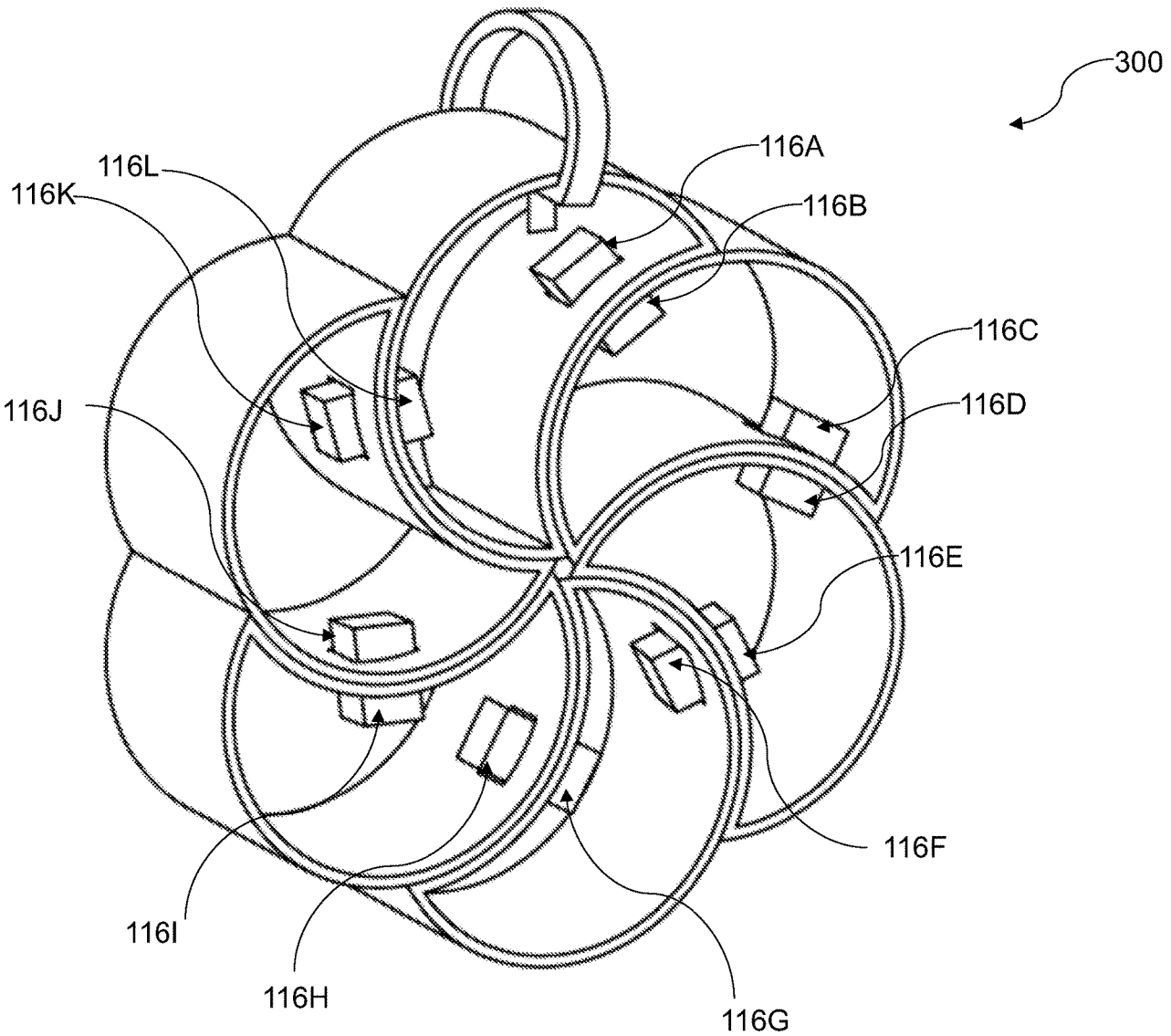
Figure 7Y:
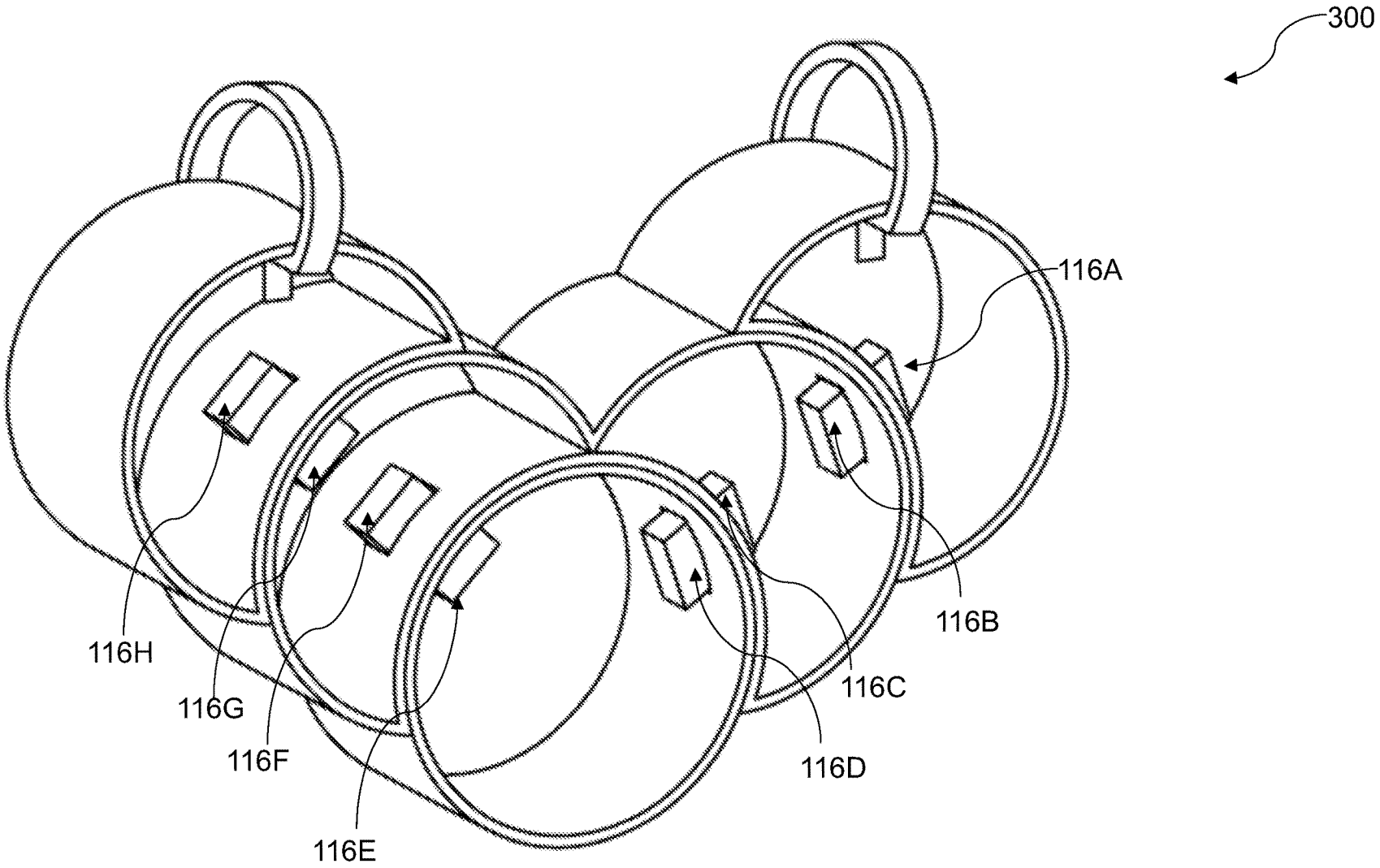
Figure 7Z:
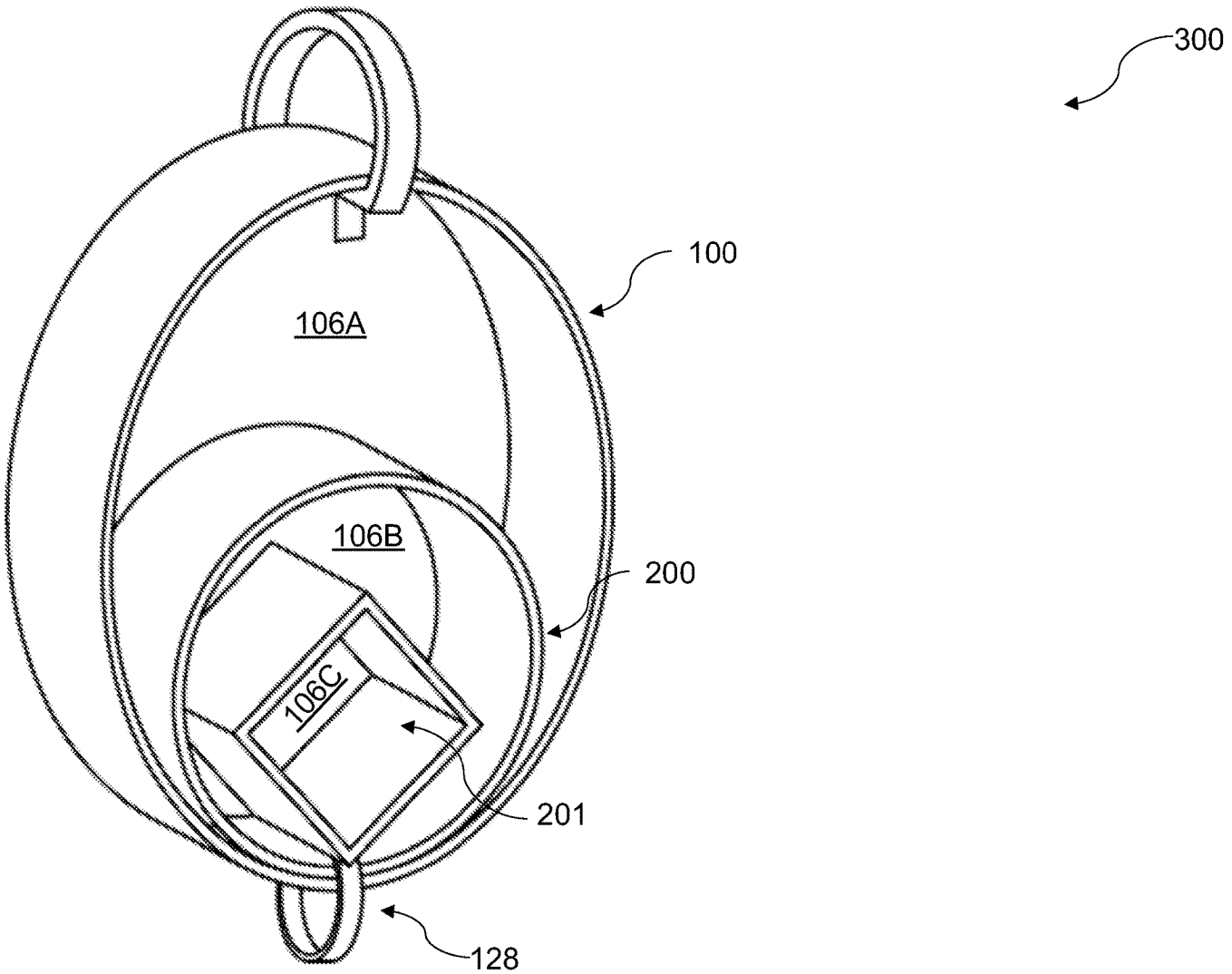

It should be appreciated that a combination of the former is also possible (as shown in FIG. 7H, FIG. 7I, FIG. 7N, and FIG. 7O). For example, as shown in FIG. 7N, the new polygonal shape 300 is formed from affixing multiple polygonal shapes 200, 201, 203 inside of a larger polygonal shape 100 and affixing another polygonal shape 205 to the larger polygonal shape 100.

Moreover, as shown in at least FIG. 7F, FIG. 7G, FIG. 7U, FIG. 7V, and FIG. 7Z, the new polygonal shape 300 formed from affixing the magnetic portion 116 of the planar portion of the second polygonal shape 200 to the magnetic portion 116 of the planar portion of the first polygonal shape 100 such that the second polygonal shape 200 is received in the first polygonal shape 100. As shown in at least FIG. 7V, the second polygonal shape 200 may be repositioned, moved, and/or reoriented within the first polygonal shape 100 due to the magnetic attraction between the magnetic portion 116 located in the planar portion of the first polygonal shape 100 and the magnetic portion 116 located in the planar portion of the first polygonal shape 200.

The new polygonal shape 300 described herein comprises a planar portion having a first side disposed opposite a second side 110, one or more exterior walls located on a periphery of the first side of the planar portion and extending away from the first side of the planar portion to form a first interior portion 106B, and one or more interior walls located on and extending away from the first side of the planar portion to form a second interior portion 106A, as shown in at least FIG. 7G.

In some examples, as shown in FIG. 7M, the new polygonal shape 300 is formed by affixing two polygonal shapes inside of the first polygonal shape 100 such that three interior portions 106A, 106B, and 106C are created. Each of the planar portion, the one or more exterior walls, and the one or more interior walls comprise another magnetic portion 116. In a first example, the other magnetic portion 116 of the new polygonal shape 300 is located within each of the planar portion, the one or more exterior walls, and the one or more interior walls. In a second example, the other magnetic portion 116 of the new polygonal shape 300 is located within the planar portion and within each of the one or more interior walls and the other magnetic portion 116 of the new polygonal shape 300 is affixed to each of one or more exterior walls.

In a preferred embodiment of the present invention, the magnets used may be rare-earth magnets, which are strong permanent magnets made from alloys of rare earth elements. Each of the magnetic portion 116 and the other magnetic portion 116 are selected from the group consisting of: a cobalt magnet, a neodymium magnet, a samariun cobalt magnet, and another rare earth magnet. Neodymium magnets are a member of the rare earth magnet family. They are called "rare earth" because neodymium is a member of the "rare earth" elements on the periodic table. Neodymium magnets are the strongest of the rare earth magnets and are the strongest permanent magnets in the world. They are extremely strong for their small size.

As shown in at least FIG. 7F, the jewelry kit also includes a first set of objects 126A receivable in the first interior portion 106A of the new polygonal shape 300 and a second set of objects 126B receivable in the second interior portion 106B of the new polygonal shape 300. In some examples, the first set of the objects 126A is identical to the second set of the objects 126B. In another example, the first set of the objects 126A differs from the second set of the objects 126B. Each object of the first set of the objects 126A and the second set of the objects 126B include a pearl, a gem, a precious stone, a bead, a crystal, a charm, a shell, a shrink plastic creation, a dried flower, a photograph, and/or a craft item, among others.

Figure 2:
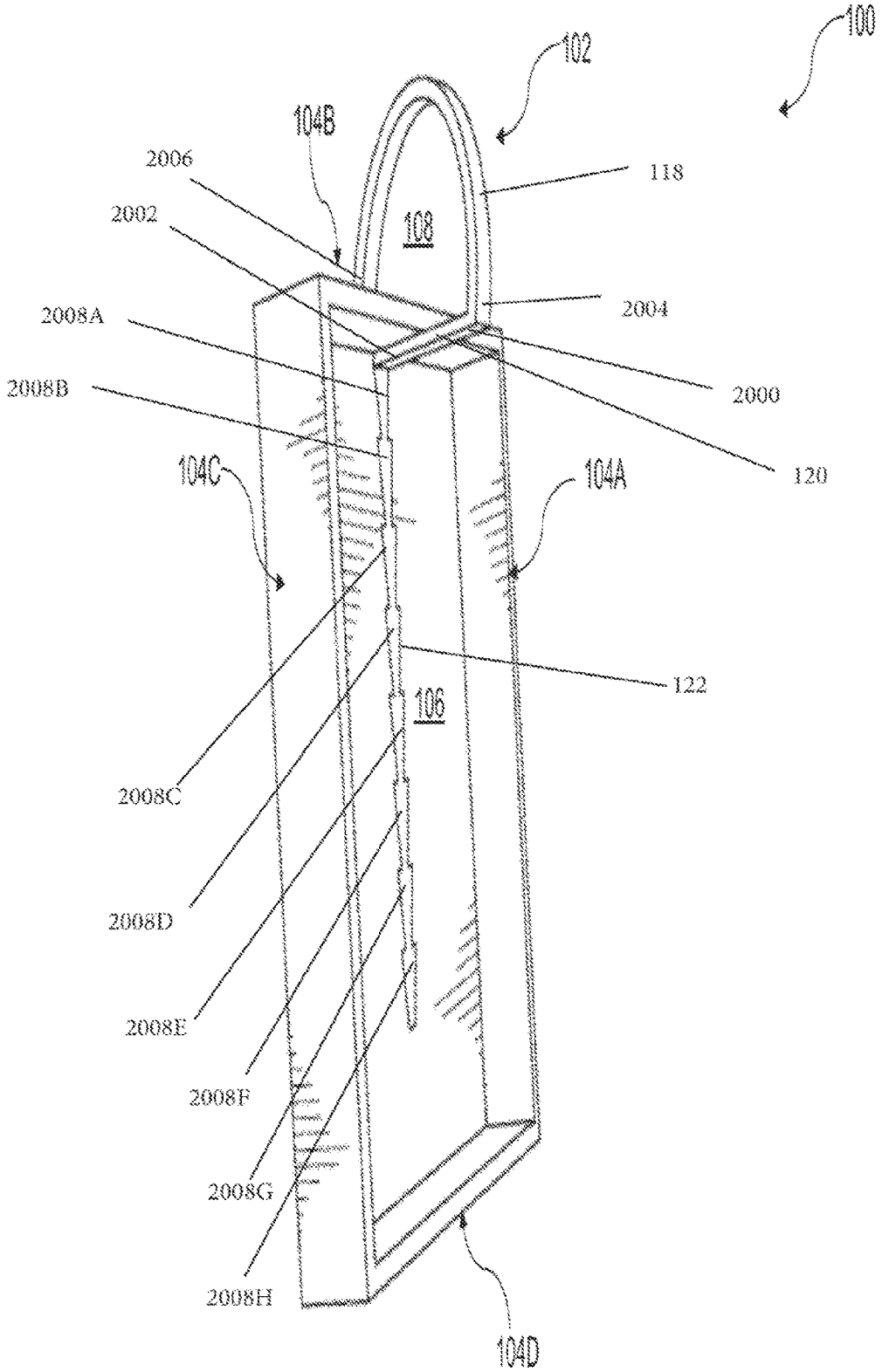
FIG. 2 depicts a side perspective view of the polygonal piece of the jewelry kit with the bale of FIG. 1, according to at least some embodiments disclosed herein.
Figure 3:
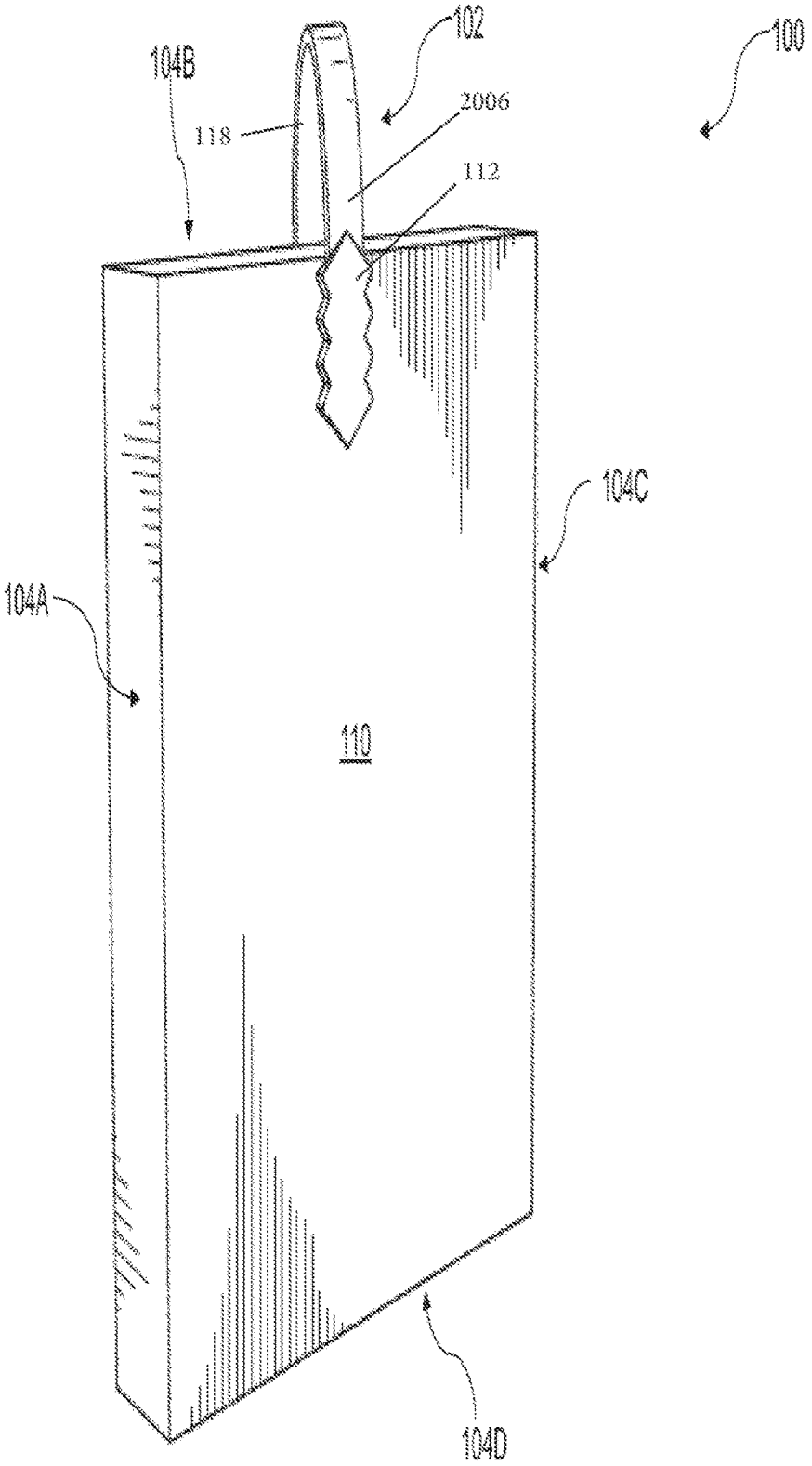
FIG. 3 depicts a rear perspective view of the polygonal piece of the jewelry kit with the bale of FIG. 1, according to at least some embodiments disclosed herein.
Figure 4:
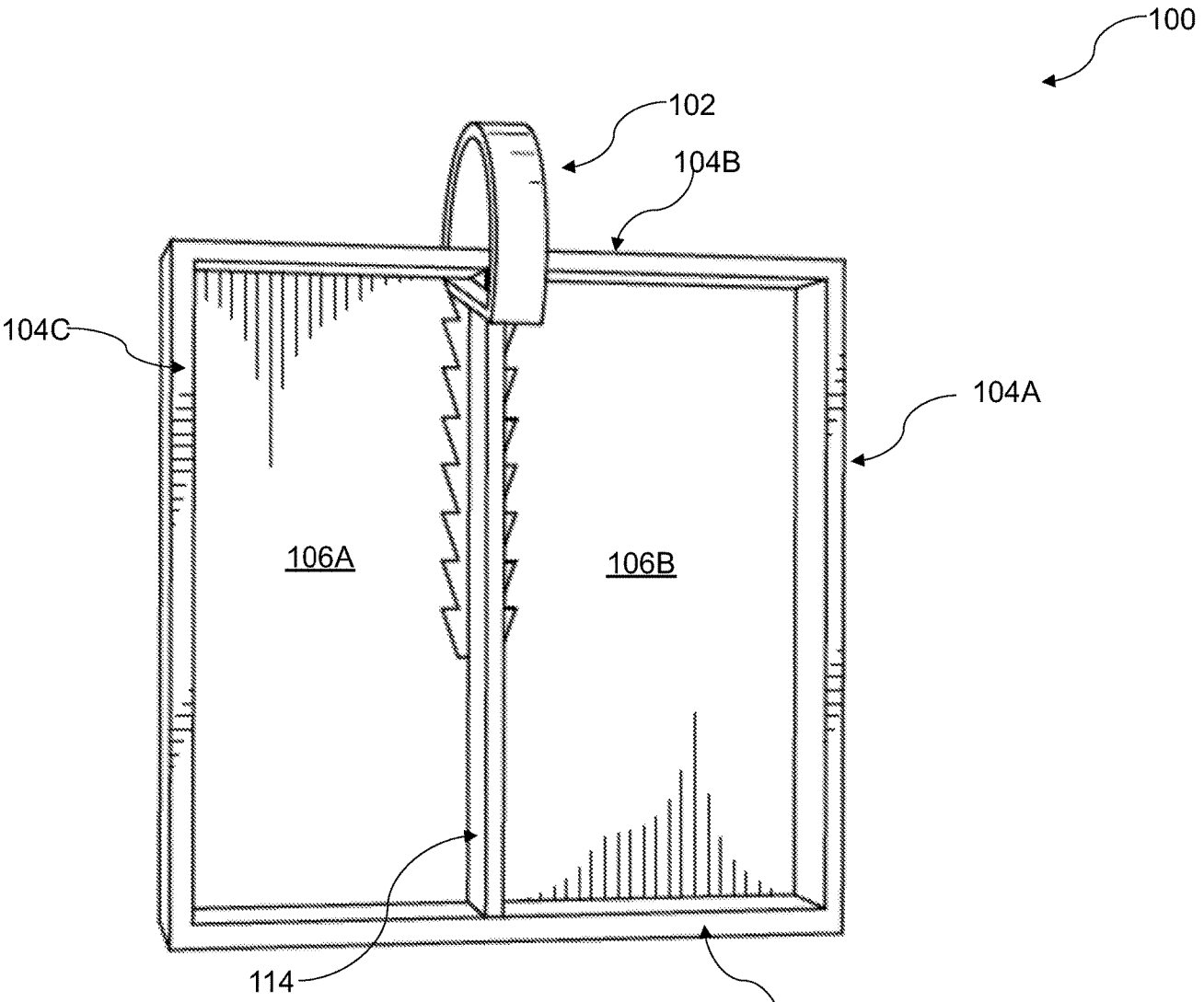
FIG. 4 depicts a perspective view of an alternative embodiment of a polygonal piece of a jewelry kit with a split bale attached, according to at least some embodiments disclosed herein.
Figure 9:
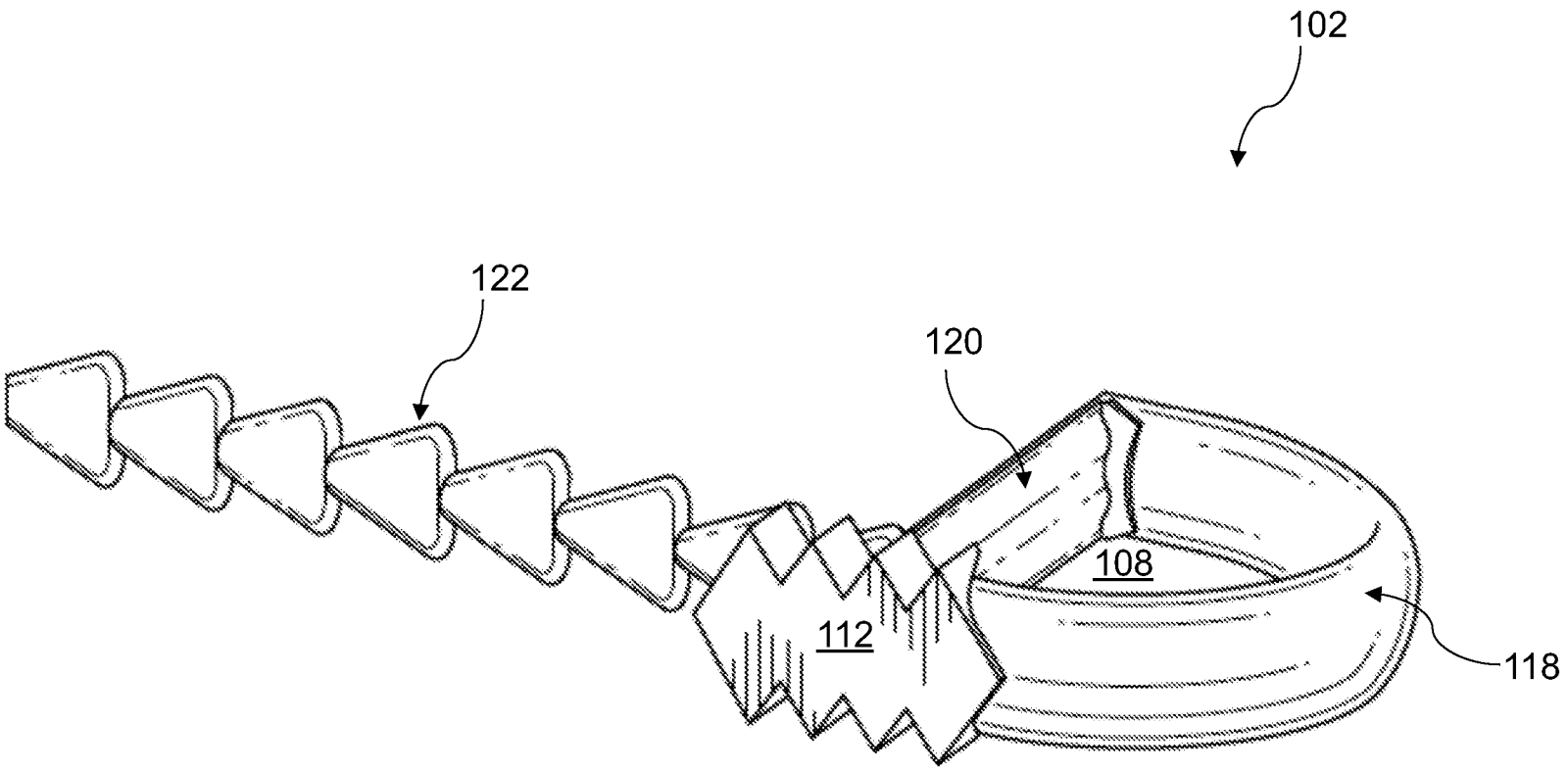
FIG. 9 depicts a perspective view of a single bale, according to at least some embodiments disclosed herein.
Figure 10:
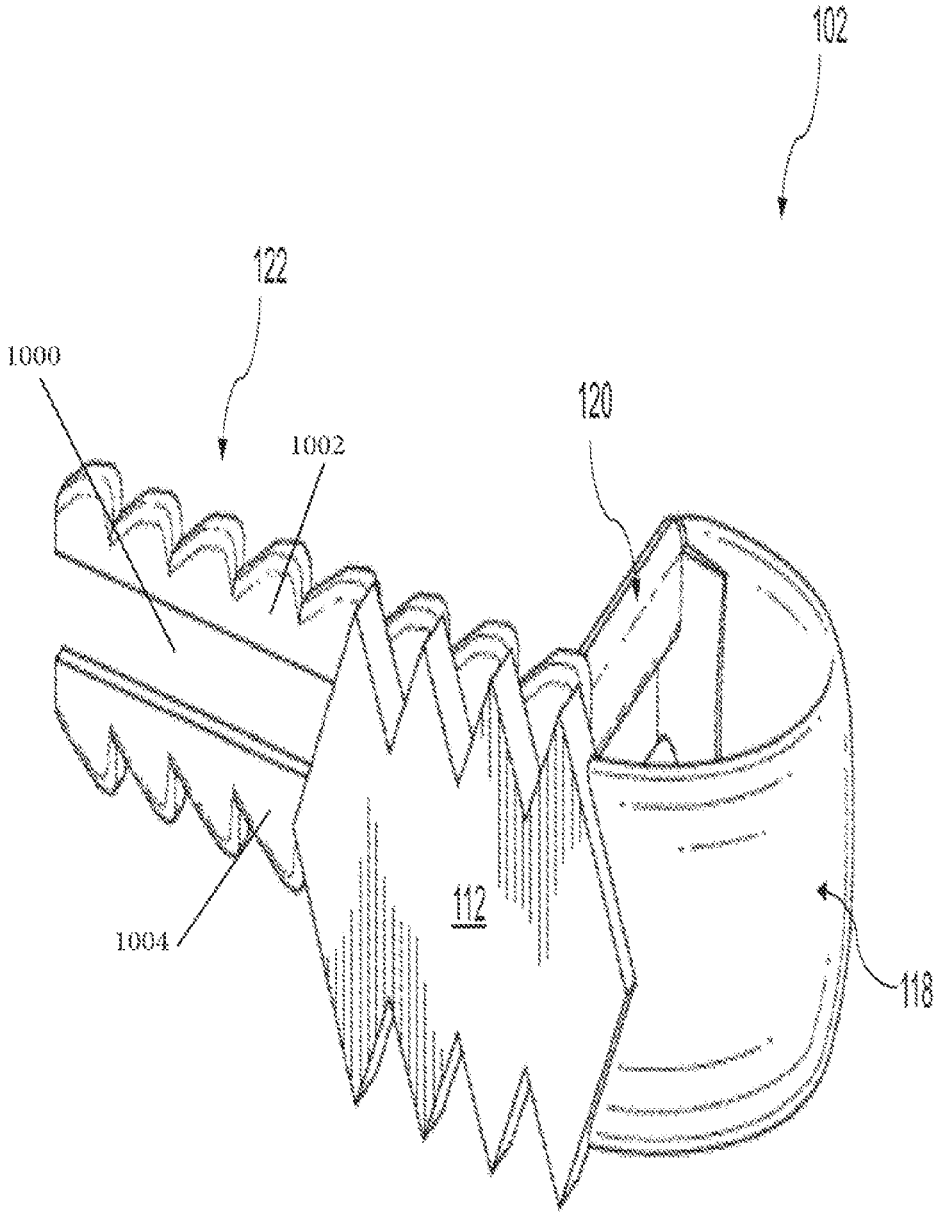
FIG. 10 depicts a perspective view of a double bale, according to at least some embodiments disclosed herein.

The jewelry kit also includes at least one adjustable bale 102 affixed to a wall of the one or more exterior walls of the new polygonal shape 300. As shown in FIG. 9 and FIG. 10, the at least one adjustable bale 102 includes a planar portion 120 and a semi-circular portion 118, forming an opening 108 therein. A location 112 is present between the semi-circular portion 118 and a jagged section 122. It should be appreciated hat the planar portion 120 is not affixed to the location 112. The planar portion 120 and the semi-circular portion 118 are made of spring-loaded materials such that the planar portion 120 is clipped or affixed to a wall of the one or more walls 104A, 104B, 104C, and/or 104D, as shown in FIG. 1, FIG. 2, and FIG. 4. The jagged section 122 extends away from the semi-circular portion 118, where an action on the jagged section 122 increases or decreases a size of the opening 108. The jagged section 122 extends on the first side of the planar portion of the new polygonal shape 300 away from the wall of the one or more walls 104A, 104B, 104C, and/or 104D. FIG. 2 shows adjustable bale 102 including planar portion 120 of adjustable bale 102 having first end 2000 located opposite second end 2002. Semi-circular portion 118 (FIGS. 2-3) has first end 2004 and second end 2006 (FIGS. 2-3). First end 2000 of planar portion 120 of adjustable bale 102 is connected to first end 2004 of semi-circular portion 118. Second end 2002 of planar portion 120 of adjustable bale 102 connected to jagged section 122. Jagged section 122 has a plurality of teeth 2008A-2008H. Each tooth of the plurality of teeth having a tapered orientation.

The jagged section 122 is toothed such that the set of objects 126 may be easily affixed to the jagged section 122. A user can cut or clip an extra portion of the jagged section 122 to make more room for a stone or gem. A component (e.g., a string, a thread, etc.) is received through the opening 108 to affix the new polygonal shape 300 to a necklace, a bracelet, a bangle, a cuff link, an earring, a belt, a broach, a pin, a keychain, a headband, an ornament, a ring, a crown, a tiara, a hairpin, a pet collar, a picture frame, an anklet, or an art piece.

The jewelry kit also includes at least one adjustable and spring-loaded jump ring 128 affixed to the wall or another wall of the one or more exterior walls of the new polygonal shape 300. As shown in at least FIG. 7H, the at least one adjustable and spring-loaded jump ring 128 is configured to receive a third set of objects 130 thereon, where each object of the third set of objects 130 includes: a pearl, a gem, a precious stone, a bead, a crystal, a charm, a shell, a shrink plastic creation, a dried flower, a photograph, or a craft item.

It should be appreciated that the at least one adjustable bale 102 and the at least one adjustable and spring-loaded jump ring 128 may be snapped onto the wall or the other wall of the one or more exterior walls of the new polygonal shape 300. A user may move the at least one adjustable bale 102 and/or the at least one adjustable and spring-loaded jump ring 128 around the wall or the other wall of the one or more exterior walls of the new polygonal shape 300 until the at least one adjustable bale 102 and/or the at least one adjustable and spring-loaded jump ring 128 reaches a desired location.

It should be appreciated that the at least one adjustable bale 102 may comprise a single jagged section 122 (of FIG. 1, FIG. 2, FIG. 3, and FIG. 9) or a double-jagged section 122

Figure 5:
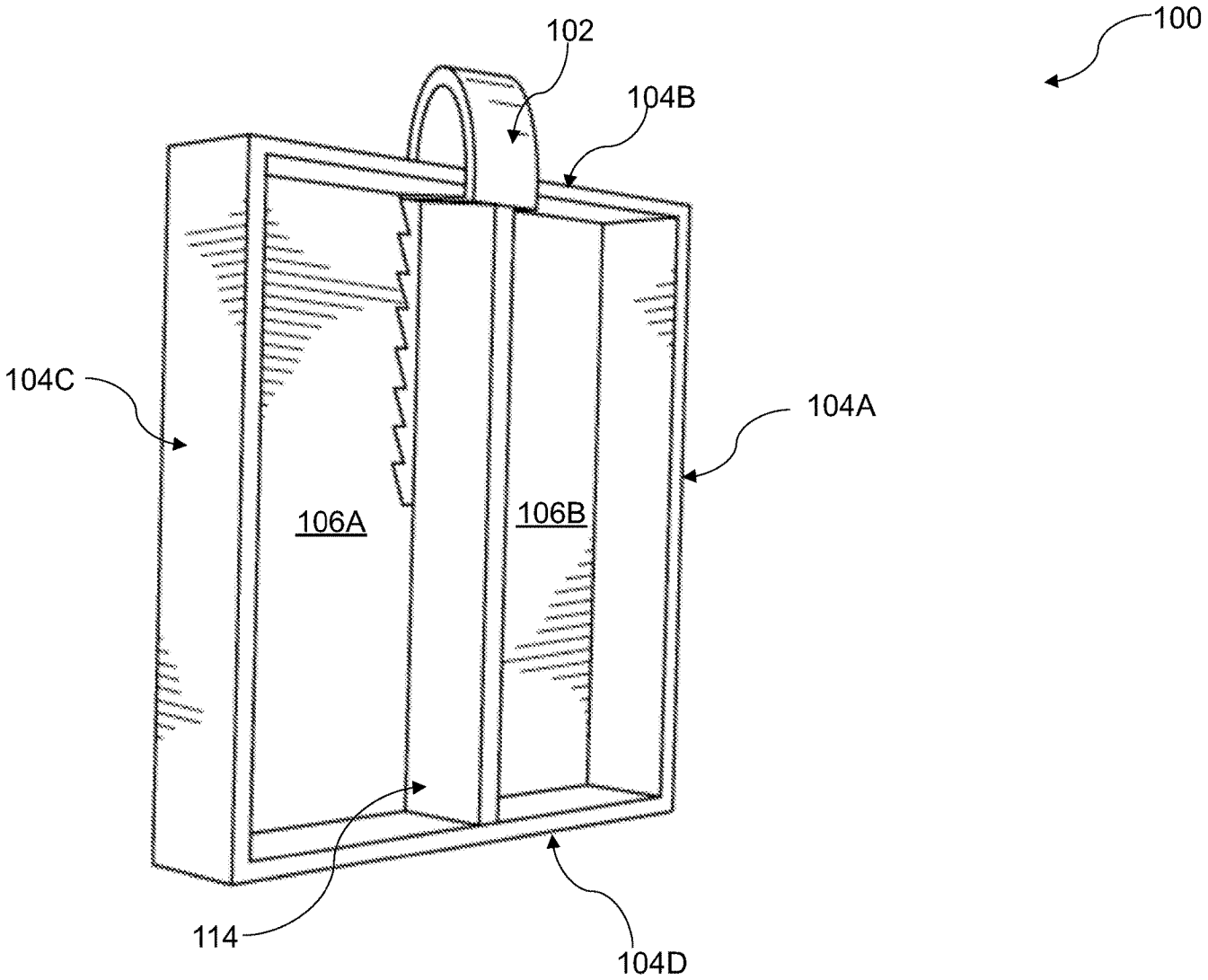
FIG. 5 depicts a side perspective view of the alternative embodiment of the polygonal piece of the jewelry kit with the split bale attached of FIG. 4, according to at least some embodiments disclosed herein.
Figure 6:
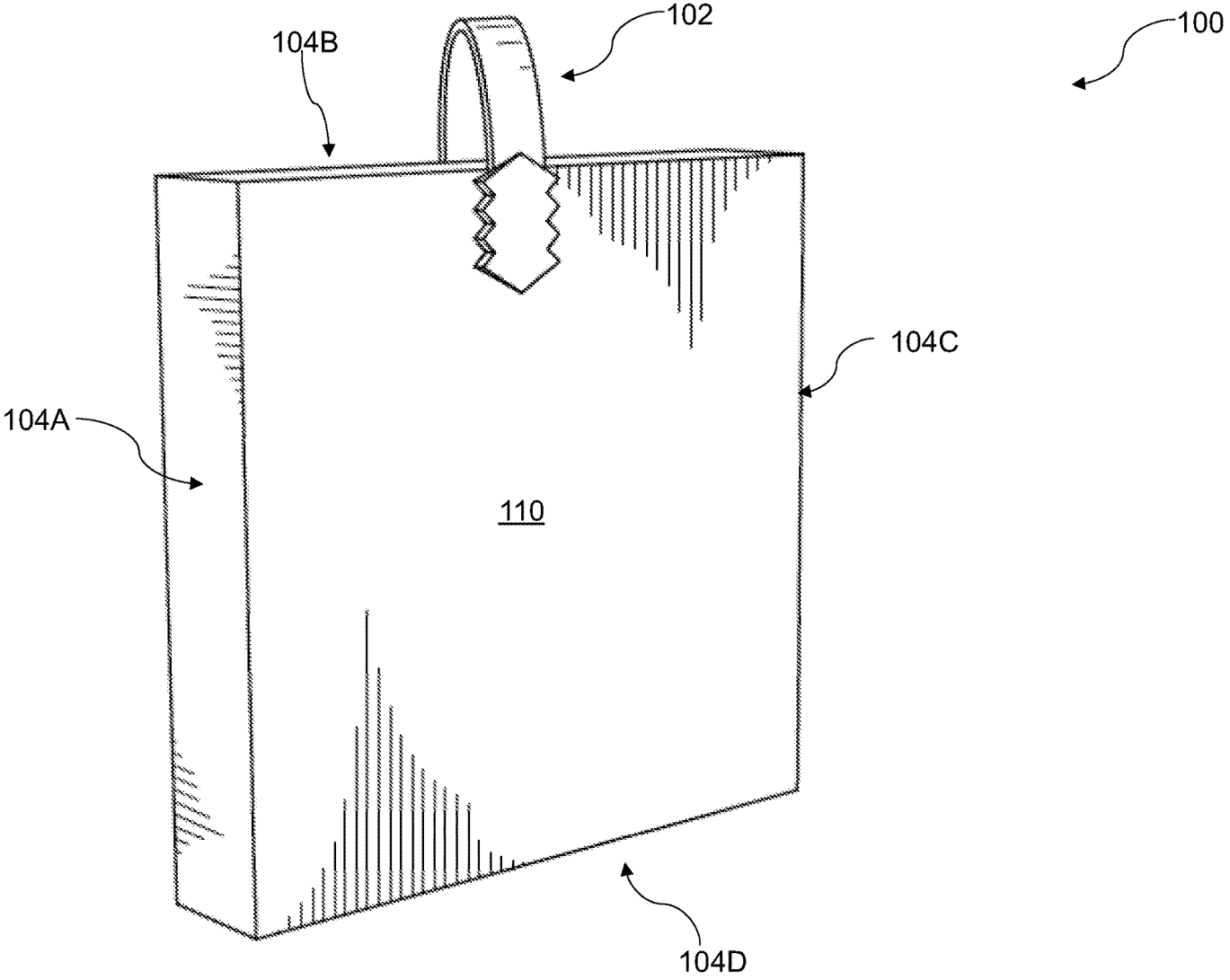
FIG. 6 depicts a rear perspective view of the alternative embodiment of the polygonal piece of the jewelry kit with the split bale attached of FIG. 4, according to at least some embodiments disclosed herein.

(of FIG. 4, FIG. 5, FIG. 10). As shown in FIG. 4, the double jagged section 122 divides the interior into two sections, the first interior section 106A and the second interior section 106B, via a wall 114. FIG. 10 shows jagged section 122 of adjustable bale 102 having channel 1000 separating jagged section 122 into a first side 1002 and a second side 1004.

As described herein, a "bale or bail" are the top loop on a pendant that the chain, leather or any type of necklace, slides through. A bale is a component of certain types of jewelry, mostly necklaces, that is used to attach a pendant or stone so the piece can be easily added to a chain or other form of necklace like leather. The bail normally comes placed in the center of the bezel pendant where the pendant hangs. The bails in the present invention are made so that they can be attached wherever the user wishes. This creates endless options for the user in their designing of a piece of jewelry. For example, a user, instead of using a pre-formed oval bezel that has the bail placed on the long side of the bezel, can instead place the bail on the short side of the oval, hanging the bezel in a horizontal instead of vertical manner.

In the preferred embodiment of the present invention, the at least one adjustable bale 102 expands the jewelry-making options by making it possible for focal pieces to be easily transformed into pendants without the use of metalsmithing or soldering equipment, or glues. In the preferred embodiment of the present invention, the at least one adjustable bale 102 is designed with a spring loaded adjustable tongue, that can be cut to fit the size needed, so they can attach to any polygonal bezel piece, anywhere desired. There is also a split double bale the can be used to join two bezels together creating even more possible design combinations for the user. This allows the user to design easily without any extra tools. Where a user places the at least one adjustable bale 102 on a pendant can make a big difference in design aesthetics and creative choices.

In the preferred embodiment of the present invention, a smaller bale or jump ring may be used. The jump rings are designed with spring loaded adjustable tongue so they can attached to any bezel (e.g., the new polygonal shape 300) at any location giving the user endless options for adding embellishments like beads, crystals or other decorative media to complete the user's designs. Normally, just like bails, soldering or glue would be needed, but not with the present invention's jump rings or bales. This allows the user to design easily without any extra tools.

The jewelry kit also includes at least one adjustable bale 102 affixed to a wall of the one or more exterior walls of the new polygonal shape 300 and at least one adjustable and spring-loaded jump ring 128 affixed to the wall or another wall of the one or more exterior walls of the new polygonal shape 300. The jewelry kit may also include a spring-loaded frame (not shown) affixed to a periphery of the one or more exterior walls of the new polygonal shape 300.

Traditional bezels may be shaped into the size and shape of the gem and then a bale and/or jump rings soldered into place. The prepared stone is then placed into the bezel and the metal is pressed down over the edges of stone, locking it into place. This bezel kit of the instant invention eliminates all those steps. A user may choose from a variety of interlocking bezel shapes to create endless combinations of designs. With the present invention, the user can simply place into the pre-done bezels a huge assortment of materials, with the ability to place the bale and jump rings wherever the user wishes, plus the ability to change the look of the jewelry piece even after fabrication without soldering.

In another embodiment, each of the one or more walls 104A, 104B, 104C, and/or 104D of the first polygonal shape 100 and/or the second polygonal shape 200 comprise the magnetic portion 116. In this embodiment, the new polygonal shape 300 is formed from affixing the magnetic portion 116 of at least one wall of the one or more walls 104A, 104B, 104C, and/or 104D of the first polygonal shape 100 to the magnetic portion 116 of at least one wall of the one or more walls 104A, 104B, 104C, and/or 104D of the second polygonal shape 200. The new polygonal shape 300 includes: a planar portion having a first side disposed opposite a second side 110 and one or more walls located on a periphery of the first side of the planar portion and extending away from the first side of the planar portion to form an interior portion 106. Each of the one or more walls comprise another magnetic portion 116.

A set of objects 126 is receivable in the interior portion 106 of the new polygonal shape 300. Moreover, at least one adjustable bale 102 is affixed to a wall of the one or more walls of the new polygonal shape 300 and at least one adjustable and spring-loaded jump ring 128 affixed to the wall or another wall of the one or more walls of the new polygonal shape 300. The at least one adjustable and spring-loaded jump ring 128 is deformable. Moreover, a component is received by the at least one adjustable bale to affix the new polygonal shape 300 to a necklace, a bracelet, a bangle, a cuff link, an earring, a belt, a broach, a pin, a keychain, a headband, an ornament, a ring, a crown, a tiara, a hairpin, a pet collar, a picture frame, an anklet, or an art piece.

In a third embodiment of the jewelry kit, magnetic portions 116 are not used. In this embodiment, the new polygonal shape 300 is formed from affixing, via an adhesive, the planar portion of the second polygonal shape 200 to the planar portion of the first polygonal shape 100 such that the second polygonal shape 200 is received in the first polygonal shape 100. The new polygonal shape 300 comprises: a planar portion having a first side disposed opposite a second side 110, one or more exterior walls located on a periphery of the first side of the planar portion and extending away from the first side of the planar portion to form a first interior portion 106A, and one or more interior walls located on and extending away from the first side of the planar portion to form a second interior portion 106B. A paint, an enamel, an ink, and/or a gloss are received in the first interior portion 106A and/or the second interior portion 106B.

The jewelry kit also includes the first set of objects 126A receivable in the first interior portion 106A of the new polygonal shape 300 and the second set of objects 126B receivable in the second interior portion 106B of the new polygonal shape 300. In a first example, the first set of the objects 126A is identical to the second set of the objects 126B. In a second example, the first set of the objects 126A differ from the second set of the objects 126B.

In some examples, the first set of the objects 126A are affixed in the first interior portion 106A and the second set of the objects 126B are affixed in the second interior portion 106B via an adhesive. The adhesive may be: a glue, a tape, a spray, a mod podge, a clay, a concentrate, a resin, an embossing powder, an apoxie sculpt, and/or an enamel. The clay may be: a polymer clay, a paper clay, a metal clay, and/or a crystal clay.

Figure 8:
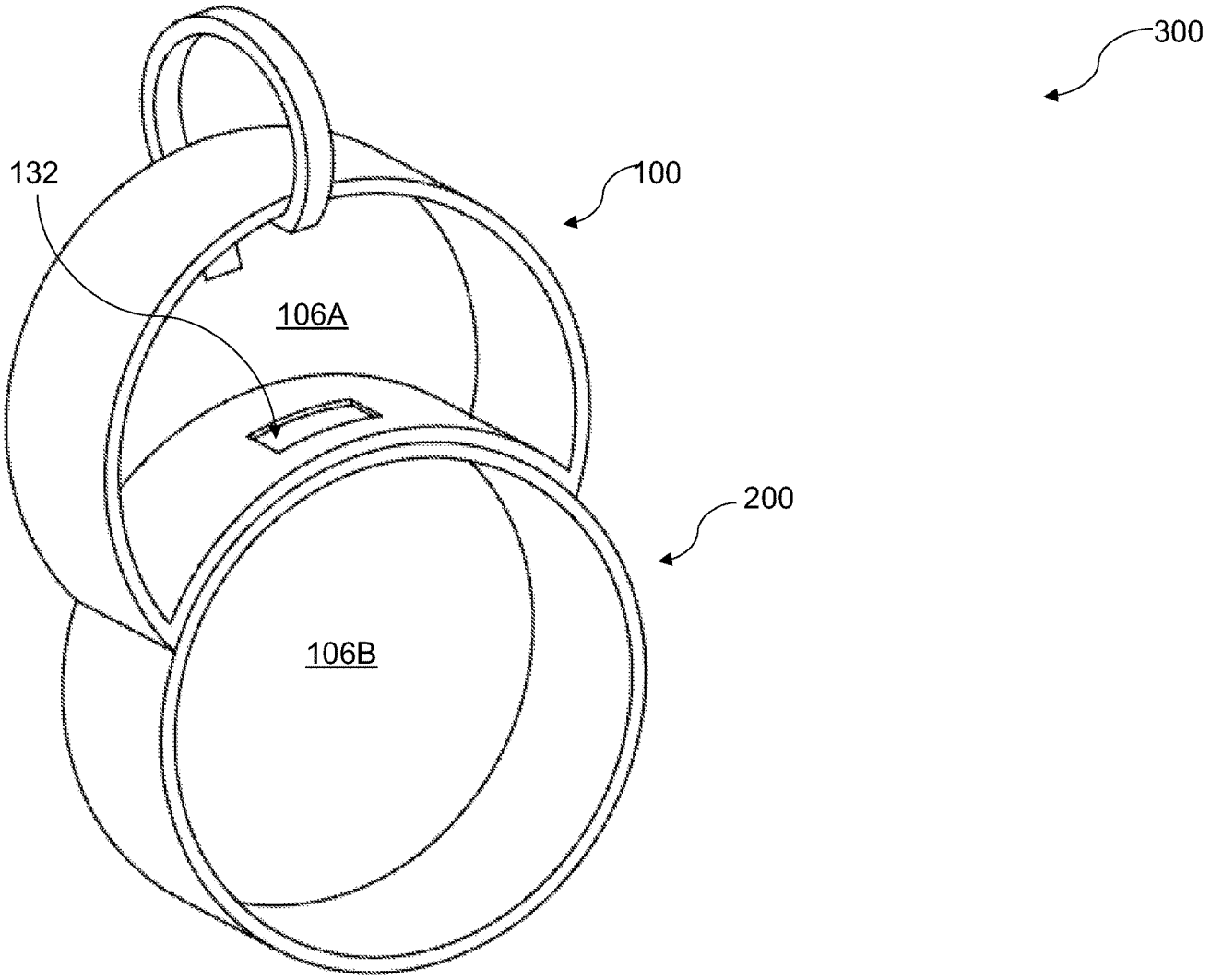
FIG. 8 depicts a perspective view of an indentation configured to receive a magnet therein, according to at least some embodiments disclosed herein.

In further embodiments. and as shown in FIG. 8, a wall of the one or more walls 104A, 104B, 104C, and/or 104D of each of the first polygonal shape 100 and the second polygonal shape 200 comprise a notched area 132 such that an object/component may be fit snuggly inside the notched area 132 to affix the first polygonal shape 100 to the second polygonal shape 200, forming the new polygonal shape 300. This makes it uniquely easy to change out different bezels even after the piece is completely designed and fabricated to take on a totally different look.

One advantage of the "bezel setting" as compared to a "prong setting" is that whatever "art" or "fabrication" that is used in the bezel is better protected from accidental rubbing or blows, and is less likely to scratched or damaged. The bezel setting is also more secure, so objects set are less likely to be dislodged by the wearer's activity. All the shapes are designed to work with each other, designed in scale and proportion. All polygonal pieces fit perfectly inside each other creating a multitude of designs. Shapes can be used in a reverse portion with metal side up as well creating even more design possibilities. The bezels in this kit are made from a variety of metals, from base metal to precious metal.

A user can use all sorts of materials in conjunction with the present invention. These materials can be used within the interior portions of the polygonal pieces or as applied to the side walls of the polygonal pieces or bezels. Materials include: resins, concrete, acrylic paints, polymers, paper clays, glass embellishments, glitters, powder coatings and fibers. For example, resins can be used to embed or encase almost any object in crystal clear plastic. Clear polyester casting resin is an exciting and fun craft that allows a user to embed or encase almost any object in crystal clear plastic as well as resin that has been colored. Color dyes and pigments are optional and can be used to create a variety of special effects, colors and backgrounds.

Concrete is lighter then stone, resin or metal of comparable size, making it perfect to use in this kit. Concrete is so strong one can use it in a bezel. Gems, crystals, metal clay, polymer clay and found objects may be placed into the concrete for a permanent cold-connected piece using the kits bezels. Micro nuts and bolts may be placed into the concrete creating ways to attach other elements to your piece.

The bezels of the present invention can be painted with acrylic and specialty paints. Acrylic paints can create background colors and textures in the bezels. Acrylic paint can be can be applied with a brush or dropper or poured directly from the bottle into the bezel.

Polymer clay is a type of hardenable modeling clay based on the polymer polyvinyl chloride (PVC). Polymer clay is generally used for making arts and craft items, and is also used in commercial applications to make decorative parts. Polymer clay is, a pliable, bendable polymer compound for artists and crafters. Polymer clay can easily fill a bezel as well as hold embeddables like crystals, stones, or glass ephemera.

Paper clay is a unique air hardening modeling material that requires no firing in a kiln or baking in an oven. It is clean, odorless and easy to use. It feels similar to an earthen clay; however, it contains no clay in it at all. A user can also add color. Paper clays can be sculpted, molded or shaped while it's moist and it accepts and retains fine details. It can be used beautifully with the present invention as an additional medium to use create a personalized piece of jewelry.

Fibers can also be featured in any of the bezels in this kit. Glass embellishments and glitters can be encased in the bezels and held with glues. Powder coating can be easily added to the outside of the bezels and baked in toaster over changing the color of the metal from its original color to an array of powder coating colors. The bezels can be put in a toaster oven without any coating and at a low temperature create a colored patina to the metal surface. Crystal embellishments can be attached or secured to the polygonal piece without heat or glue. A user can snap on an adjustable jump ring and then add a variety of embellishments such as pearls, crystals, beads.

In another embodiment, the metals used would be precious metals, such as sterling silver, gold, Lucite, and/or plastics. In another embodiment, the kit would come with materials to fill the bezels. In yet another embodiment, written, video and audio instructions could be downloaded for additional ideas. In another embodiment, the kit could come with a variety of ready to wear necklaces such as chains and leathers, where the bezel could be slipped on when completed. In another embodiment, the kit may contain metals that may be applied with a patina, wherein the finish of the metal is changed. In another embodiment, bezels with stone settings may be included that could accommodate faceted stones, like diamonds.

In another embodiment, slots or slits in the side of the bezel may be configured where a bale with a "biscuit' end could be inserted. In another embodiment, a "frame" with the bale may be attached. In this embodiment, the bezel would pop or snap into the frame and the bezel could be rotated where desired. In another embodiment, glue may be used on bales which contain recessed areas. In yet another embodiment, small holes in bezels with bales that have a matching size pin that could be pushed in like a rivet. In yet another embodiment, a bezel may be configured with multiple bales attached and a user may cut off the ones not needed or desired.

Thus, as described, the instant invention provides endless combinations for the creation of jewelry.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A jewelry kit assembly comprising:

a first shape; and a second shape, wherein each of the first shape and the second shape comprise:

a planar portion having a first side disposed opposite a second side;

a peripheral wall extending away from the first side of the planar portion to form an interior portion, the peripheral wall comprising a magnetic portion;

wherein a combined shape is formed by magnetically affixing a surface of the peripheral wall of the second shape to a surface of the peripheral wall of the first and an adjustable bale comprising:

a planar portion of the adjustable bale having a first end located opposite a second end;

a jagged section;

a semi-circular portion having a first end and a second end, the first end of the planar portion of the adjustable bale connected to the first end of the semi-circular portion, the second end of the planar portion of the adjustable bale connected to the jagged section, and wherein the planar portion of the adjustable bale and the semi-circular portion forming an opening; and a location, the location is connected to the second end of the semi-circular portion, the adjustable bale is coupled to one of the first or second shapes, wherein:

the peripheral wall of the first or second shape abuts the planar portion of the adjustable bale, and the planar portion of the same shape abuts the jagged section of the adjustable bale.

2. The jewelry kit assembly of claim 1, wherein each of the first shape and the second shape are selected from the group consisting of: a circular shape, an oval shape, a rectangular shape, a diamond shape, a moon shape, a star shape, a heart shape, a half-moon shape, a half circle shape, a pie slice shape, a square shape, a triangular shape, a quadrilateral shape, a pentagonal shape, a hexagonal shape, a heptagonal shape, an octagonal shape, a nonagonal shape, and a decagonal shape.

3. The jewelry kit assembly of claim 1, wherein the adjustable bale and the combined shape are configured to attach to one of a necklace, a bracelet, a bangle, a cuff link, an earring, a belt, a broach, a pin, a keychain, a headband, an ornament, a ring, a crown, a tiara, a hairpin, a pet collar, a picture frame, an anklet, or an art piece.

4. The jewelry kit assembly of claim 1, further comprising:

a first set of objects receivable in the interior portion of the first shape of the combined shape, each objects of the first set adhesively coupled to the first side of the planar portion of the first shape; and a second set of objects receivable in the interior portion of the second shape of the combined shape, each object of the second set adhesively coupled to the first side of the planar portion of the second shape;

wherein each object of the first and second sets of objects is selected from the group consisting of: a pearl, a gem, a precious stone, a bead, a crystal, a charm, a shell, a shrink plastic creation, a dried flower, a photograph, and a craft item.

5. The jewelry assembly of claim 1, further comprising:

a first set of objects adhesively coupled to a planar portion of the first interior portion of the combined shape formed by the first shape;

a second set of objects adhesively coupled to a planar portion of the second interior portion of the combined shape formed by the second shape;

a first adjustable bale comprising:

a planar portion of the adjustable bale having a first end located opposite a second end;

a jagged section, the jagged section is toothed and extends away from the semi-circular portion;

a semi-circular portion having a first end and a second end, the first end of the planar portion of the adjustable bale connected to the first end of the semi-circular portion, the second end of the planar portion of the adjustable bale connected to the jagged section, and wherein the planar portion of the adjustable bale and the semi-circular portion forming an opening; and a location, the location is connected to the second end of the semi-circular portion, the first adjustable bale is slidingly coupled to a peripheral wall of the combined shape, and wherein the planar portion of the first adjustable bale and the semi-circular portion of the first adjustable bale are made of a spring-loaded material and configured for the planar portion of the first adjustable bale to be clipped to the peripheral wall of the combined shape, the first adjustable bale disposed at a first position as a top of the combined shape; and a second adjustable bale comprising:

a planar portion of the adjustable bale having a first end located opposite a second end;

a jagged section, the jagged section is toothed and extends away from the semi-circular portion;

a semi-circular portion having a first end and a second end, the first end of the planar portion of the adjustable bale connected to the first end of the semi-circular portion, the second end of the planar portion of the adjustable bale connected to the jagged section, and wherein the planar portion of the adjustable bale and the semi-circular portion forming an opening; and a location, the location is connected to the second end of the semi-circular portion, the second adjustable bale is slidingly coupled to a peripheral wall of the combined shape, and wherein the planar portion of the second adjustable bale and the semi-circular portion of the second adjustable bale are made of a spring-loaded material and configured for the planar portion of the first adjustable bale to be clipped to the peripheral wall of the combined shape, the second adjustable bale disposed at a second position opposite the first position as a bottom of the combined shape.

6. The jewelry kit assembly of claim 1, wherein the jagged section of the adjustable bale having a channel separating the jagged section into a first side and a second side.

7. A jewelry kit assembly comprising:

a first shape; and a second shape, wherein each of the first shape and the second shape comprise:

a planar portion having a first side disposed opposite a second side;

a peripheral wall extending away from the first side of the planar portion to form an interior portion;

wherein a combined shape is formed by affixing, via an adhesive, the planar portion of the second shape to the planar portion of the first shape such that the second shape is received in the interior portion of the first shape; and an adjustable bale comprising:

a planar portion of the adjustable bale having a first end located opposite a second end;

a semi-circular portion;

a jagged section, the jagged section is toothed and extends away from the semi-circular portion, the semi-circular portion having a first end and a second end, the first end of the planar portion of the adjustable bale connected to the first end of the semi-circular portion, the second end of the planar portion of the adjustable bale connected to the jagged section, and wherein the planar portion of the adjustable bale and the semi-circular portion forming an opening; and a location, the location is connected to the second end of the semi-circular portion, the adjustable bale is coupled to one of the first or second shapes, wherein:

the peripheral wall of the first or second shape abuts the planar portion of the adjustable bale, and the planar portion of the same shape abuts the jagged section of the adjustable bale.

8. The jewelry kit assembly of claim 7, wherein a paint, an enamel, and/or an ink, are received in at least one of the first interior portion and the second interior portion.

9. The jewelry kit assembly of claim 7, further comprising:

a first set of objects affixed in the interior portion of the first shape, and a second set of objects affixed in the interior portion of the second shape, wherein:

at least one object of the first and second sets of objects is affixed by an adhesive selected from the group consisting of:

a glue, a tape, a spray, a mod podge, a clay, a concentrate, a resin, an embossing powder, and an enamel.

10. The jewelry kit assembly of claim 9, wherein the clay is selected from the group consisting of: a polymer clay, a paper clay, a metal clay, and a crystal clay.

11. A jewelry kit assembly comprising:

a first shape; and a second shape, wherein each of the first shape and the second shape comprise:

a peripheral wall around a planar portion having a first side disposed opposite a second side and extending away from the first side of the planar portion to form an interior portion, wherein each of the peripheral walls comprises a magnetic portion;

wherein a combined shape formed by affixing the magnetic portion of the peripheral wall of the first shape to the peripheral wall of the second shape; and an adjustable bale comprising:

a planar portion of the adjustable bale having a first end located opposite a second end;

a semi-circular portion;

a jagged section, the jagged section having a plurality of teeth, each tooth of the plurality of teeth having a tapered orientation, and wherein the jagged section extends away from the semi-circular portion; the semi-circular portion having a first end and a second end, the first end of the planar portion of the adjustable bale connected to the first end of the semi-circular portion, the second end of the planar portion of the adjustable bale connected to the jagged section, and wherein the planar portion of the adjustable bale and the semi-circular portion forming an opening; and a location, the location is connected to the second end of the semi-circular portion, the adjustable bale is coupled to one of the first or second shapes, wherein:

the peripheral wall of the first or second shape abuts the planar portion of the adjustable bale, and the planar portion of the same shape abuts the jagged section of the adjustable bale.

12. The jewelry kit assembly of claim 11, wherein each of the magnetic portions comprise magnetic material selected from the group consisting of: a cobalt magnet, a neodymium magnet, a samariun cobalt magnet, and another rare earth magnet.

13. The jewelry kit assembly of claim 11, wherein a component is received by the adjustable bale to hang the combined shape as a necklace, a bracelet, a bangle, a cuff link, an earring, a belt, a broach, a pin, a key chain, a headband, an ornament, a ring, a crown, a tiara, a hairpin, a pet collar, a picture frame, an anklet, or an art piece.

14. The jewelry assembly of claim 11, further comprising a second adjustable bale coupled to the wall of the combined shape opposite the adjustable bale, for hanging an object from the combined shape.

* * * * *